US012650008B2

(12) United States Patent
Thomas et al.

(10) Patent No.: US 12,650,008 B2
(45) Date of Patent: Jun. 9, 2026

(54) ELECTRONIC SHOWER VALVE

(71) Applicant: Delta Faucet Company, Indianapolis, IN (US)

(72) Inventors: Kurt Judson Thomas, Indianapolis, IN (US); Mark A. Cipriani, Carmel, IN (US); Michael Scot Rosko, Greenwood, IN (US); Randy L. Schneider, II, Carmel, IN (US); Garry Robin Marty, Fishers, IN (US)

(73) Assignee: Delta Faucet Company, Indianapolis, IN (US)

( * ) Notice: Subject to any disclaimer, the term of this patent is extended or adjusted under 35 U.S.C. 154(b) by 245 days.

(21) Appl. No.: 17/345,304

(22) Filed: Jun. 11, 2021

(65) Prior Publication Data

US 2021/0388584 A1 Dec. 16, 2021

Related U.S. Application Data

(60) Provisional application No. 63/039,915, filed on Jun. 16, 2020.

(51) Int. Cl.
*E03C 1/05* (2006.01)
*E03C 1/04* (2006.01)

(52) U.S. Cl.
CPC ..... *E03C 1/055* (2013.01); *E03C 2001/0418* (2013.01)

(58) Field of Classification Search
CPC ..... G05D 23/1353; G05D 23/1306; G05D 23/1326; G05D 23/1333; G05D 23/1393; E03C 1/055
See application file for complete search history.

(56) References Cited

U.S. PATENT DOCUMENTS

| | | | |
|---|---|---|---|
| 5,199,639 | A | 4/1993 | Kobayashi et al. |
| 6,612,541 | B2 | 9/2003 | Bush et al. |
| 7,802,733 | B2 | 9/2010 | Schmitt |
| 7,819,134 | B2 | 10/2010 | Izzy et al. |
| 8,375,990 | B2 | 2/2013 | Veros |
| 8,851,451 | B2 | 10/2014 | Orino et al. |
| 9,182,047 | B2 | 11/2015 | Peel et al. |
| 9,988,797 | B2 | 6/2018 | Reeder et al. |

(Continued)

FOREIGN PATENT DOCUMENTS

| | | |
|---|---|---|
| CN | 2262636 Y | 9/1997 |
| CN | 1213053 A | 4/1999 |

(Continued)

OTHER PUBLICATIONS

MultiChoice® Universal Tub / Shower Rough—Universal Inlets / Outlets; retrieved on Jun. 17, 2021 from https://www.deltafaucet.com/bathroom/product/R10000-UNBX.html#specsTab, 3 pages.

*Primary Examiner* — Jianying C Atkisson
*Assistant Examiner* — Meraj A Shaikh
(74) *Attorney, Agent, or Firm* — Bose McKinney & Evans LLP

(57) ABSTRACT

An electronic shower valve including a coaxially aligned motor and gear assembly received within a valve body and configured to move a flow control element. Illustratively, a display is supported by the valve body and is in electrical communication with a controller. A manual override may engage with the flow control element for manual operation thereof.

33 Claims, 27 Drawing Sheets

(56) References Cited

U.S. PATENT DOCUMENTS

| | | | | |
|---|---|---|---|---|
| 10,267,022 | B2 | 4/2019 | Veros et al. | |
| 10,359,127 | B2 | 7/2019 | Dole et al. | |
| 2004/0193326 | A1 | 9/2004 | Phillips et al. | |
| 2004/0195840 | A1* | 10/2004 | Baarman | C02F 1/008 290/43 |
| 2008/0164331 | A1* | 7/2008 | Schmitt | G05D 23/1393 236/12.17 |
| 2011/0142529 | A1* | 6/2011 | Oh | E03C 1/0409 401/268 |
| 2013/0075483 | A1* | 3/2013 | Marty | E03C 1/055 236/12.1 |
| 2014/0083510 | A1 | 3/2014 | Blieske et al. | |
| 2015/0369001 | A1 | 12/2015 | Hoang | |
| 2018/0087252 | A1 | 3/2018 | Funari et al. | |
| 2019/0176173 | A1 | 6/2019 | Honeyands et al. | |
| 2019/0338502 | A1 | 11/2019 | Baker et al. | |

FOREIGN PATENT DOCUMENTS

| | | | |
|---|---|---|---|
| CN | 2725674 | Y | 9/2005 |
| CN | 109630725 | A | 4/2019 |
| EP | 3247026 | B1 | 4/2019 |
| JP | H10164797 | A | 6/1998 |
| JP | 3572600 | B2 * | 10/2004 |
| WO | 2019031971 | A1 | 2/2019 |
| WO | 2019083942 | A1 | 5/2019 |

* cited by examiner

ELECTRONIC SHOWER VALVE

CROSS-REFERENCE TO RELATED APPLICATION

The present application claims priority to U.S. provisional patent application Ser. No. 63/039,915, filed Jun. 16, 2020, the disclosure of which is expressly incorporated herein by reference.

BACKGROUND AND SUMMARY OF THE DISCLOSURE

The present invention relates to a shower valve and, more particularly, to an electronic shower valve cartridge configured to be received within a conventional shower valve body.

Electronic showers are known in the art. However, conventional electronic shower valves are often expensive, difficult to install, and unable to be retrofitted in existing roughs (valve bodies). Further, electronic shower valves are typically hard-wired to a power source (for example, an AC outlet), and some include a battery back-up. However, some users do not have a power outlet by their shower, and an electrician may need to be enlisted to install an outlet. Further still, some electronic shower valves are rendered inoperable during power loss situations.

The present invention uses an existing universal rough (valve body) to control water delivery in a shower via an electronic valve cartridge. More particularly, a universal rough that accepts known mechanical valve cartridges may be utilized to accept the electronic valve cartridge of the present disclosure. For new builds or remodels, the customer is able to purchase an existing universal rough and install that along with a new electronic valve cartridge and display. For a customer with a universal rough already installed, she can simply purchase the electronic valve cartridge and display, and install it after removing her existing mechanical valve cartridge.

The present invention is configured to utilize existing cartridge connections from a conventional rough. An outer body of the illustrative valve cartridge mates with the conventional rough so the internal mechanical components of the valve assembly are replaced with an electronic actuation method. The electronic actuation is achieved by packaging a motor and gear assembly that is able to operate existing valving. Once paired with a connected waterproof display the user is able to control the shower with an electronic user interface. For example, the user may control the shower valve with a push of a button or dial in the shower, with a remote (via phone, tablet, etc.), and/or by using an application (app) on a smart device.

This invention also achieves its purpose by providing a battery-powered electronic shower valve and/or a shower user interface. A battery may be removably carried by an escutcheon, or a battery may be part of a removable user interface for the electronic shower valve. A removable battery or a removable user interface may be recharged by coupling to a power source (for example, an AC outlet, a USB port, or the like) via a cable and/or a wall adapter, in a similar manner to a smart device (phone, tablet, etc.).

This invention also achieves its purpose by providing an electronic shower system with a manual user input. Such a manual input provides an override that may be advantageous during power loss situations or while recharging a battery of the system.

According to an illustrative embodiment of the disclosure, an electronic shower valve includes a valve body, and a valve cartridge received within the valve body. The valve cartridge includes an outer housing including an internal chamber defining a longitudinal axis, a hot water inlet in fluid communication with the internal chamber, and a cold water inlet in fluid communication with the internal chamber. A flow control element is supported for rotation about the longitudinal axis to control water flow through the hot water inlet and the cold water inlet. A motor assembly is at least partially supported within the outer housing and is coaxially aligned with the longitudinal axis. A gear assembly operably couples the motor assembly and the flow control element, and is configured to rotate the flow control element.

According to a further illustrative embodiment of the present disclosure, a shower valve cartridge includes an outer housing including an internal chamber defining a longitudinal axis, a hot water inlet in fluid communication with the internal chamber, a cold water inlet in fluid communication with the internal chamber, and a flow control element supported for rotation about the longitudinal axis to control water flow through the hot water inlet and the cold water inlet. A motor assembly is supported within the outer housing and is coaxially aligned with the longitudinal axis. A strain wave gearing assembly operably couples the motor assembly and the flow control element, and is configured to rotate the flow control element. The strain wave gearing assembly includes an outer circular spline supported by the outer housing, a flex spline cooperating with the outer circular spline, and a wave generator supported for rotation about the longitudinal axis, wherein the flex spline is positioned intermediate the wave generator and the outer circular spline.

According to a further illustrative embodiment of the present disclosure, an electronic shower system includes an electronic valve having a flow control element configured to control water flow through the electronic valve. A rechargeable power supply detachably couples to the electronic valve and is configured to power the electronic valve.

According to another illustrative embodiment of the present disclosure, a shower valve cartridge includes an outer housing having an internal chamber defining a longitudinal axis, and a flow control element supported for rotation about the longitudinal axis to control water flow. A motor assembly includes a fixed stator coaxially aligned with the longitudinal axis, and a rotor configured for rotation relative to the stator. A strain wave gearing assembly is configured to rotate the flow control element. The strain wave gearing assembly includes an outer circular spline supported by the outer housing, a flex spline cooperating with the outer circular spline and operably coupled to the flow control element, and a wave generator defined by the rotor and supported for rotation about the longitudinal axis, wherein the flex spline is positioned intermediate the wave generator and the outer circular spline.

Additional features and advantages of the present invention will become apparent to those skilled in the art upon consideration of the following detailed description of the illustrative embodiment exemplifying the best mode of carrying out the invention as presently perceived.

DETAILED DESCRIPTION OF THE DRAWINGS

Figure 1:
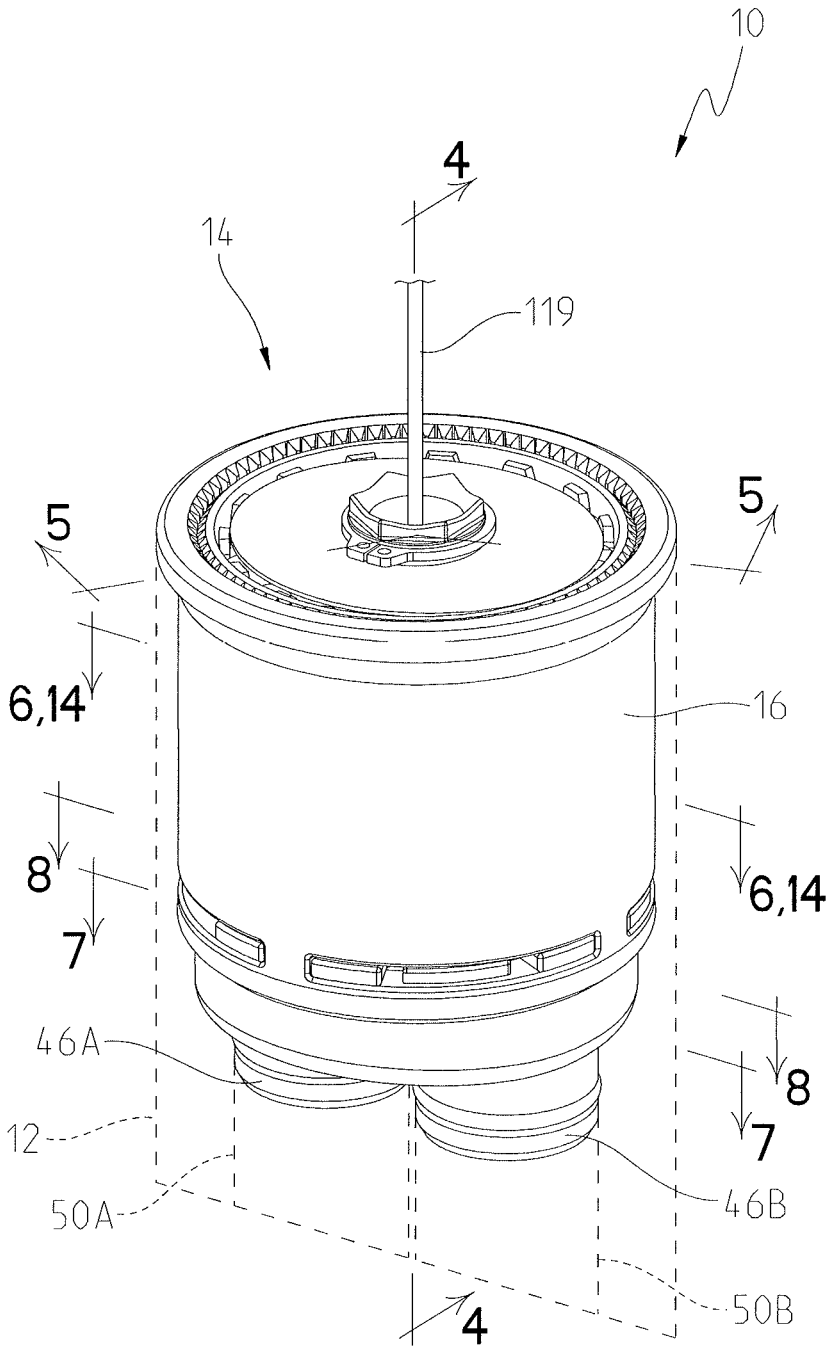
FIG. 1 is a perspective view of an illustrative valve assembly according to the present disclosure.

For the purposes of promoting and understanding the principles of the present disclosure, reference will now be made to the embodiments illustrated in the drawings, which are described herein.

With reference initially to FIG. 1, a conventional valve body 12 of the type supported within a shower wall is shown for receiving an illustrative electronic valve cartridge 14 according to the present disclosure. The valve body 12 may be, for example, MultiChoice® Universal Tub/Shower Rough—Universal Inlets/Outlets Model #: R10000-UNBX available from Delta Faucet Company of Indianapolis, Indiana. Additional details of an illustrative valve body 12 are shown in U.S. Pat. No. 7,819,134, the disclosure of which is expressly incorporated by reference herein.

With reference to FIGS. 2A-5, the electronic valve cartridge 14 illustratively includes an outer housing 16, an inner gear assembly 18, flow control members 20 and 22, a hollow valve shaft 24, a mounting nut 26, a motor assembly 28 (illustratively including a stator 30 and a rotor 32 having a cam 34), and a bearing 36 (illustratively including ball bearings 38 and a cage 39). As further detailed herein, the inner gear assembly 18 operably couples the flow control members 20 and 22 with the motor assembly 28.

Figure 4:
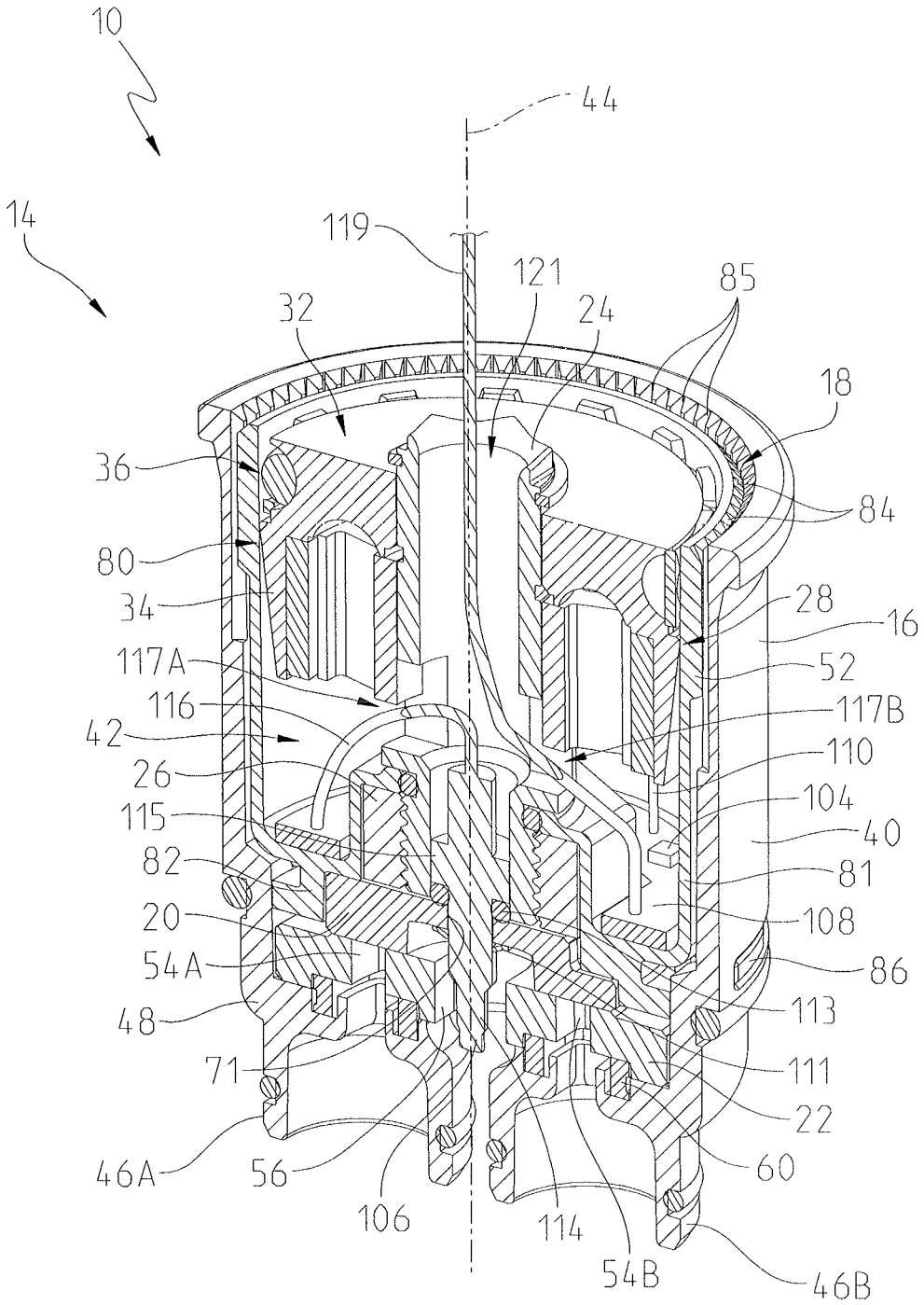
FIG. 4 is a longitudinal cross-sectional view taken along line 4-4 of FIG. 1.
Figure 5:
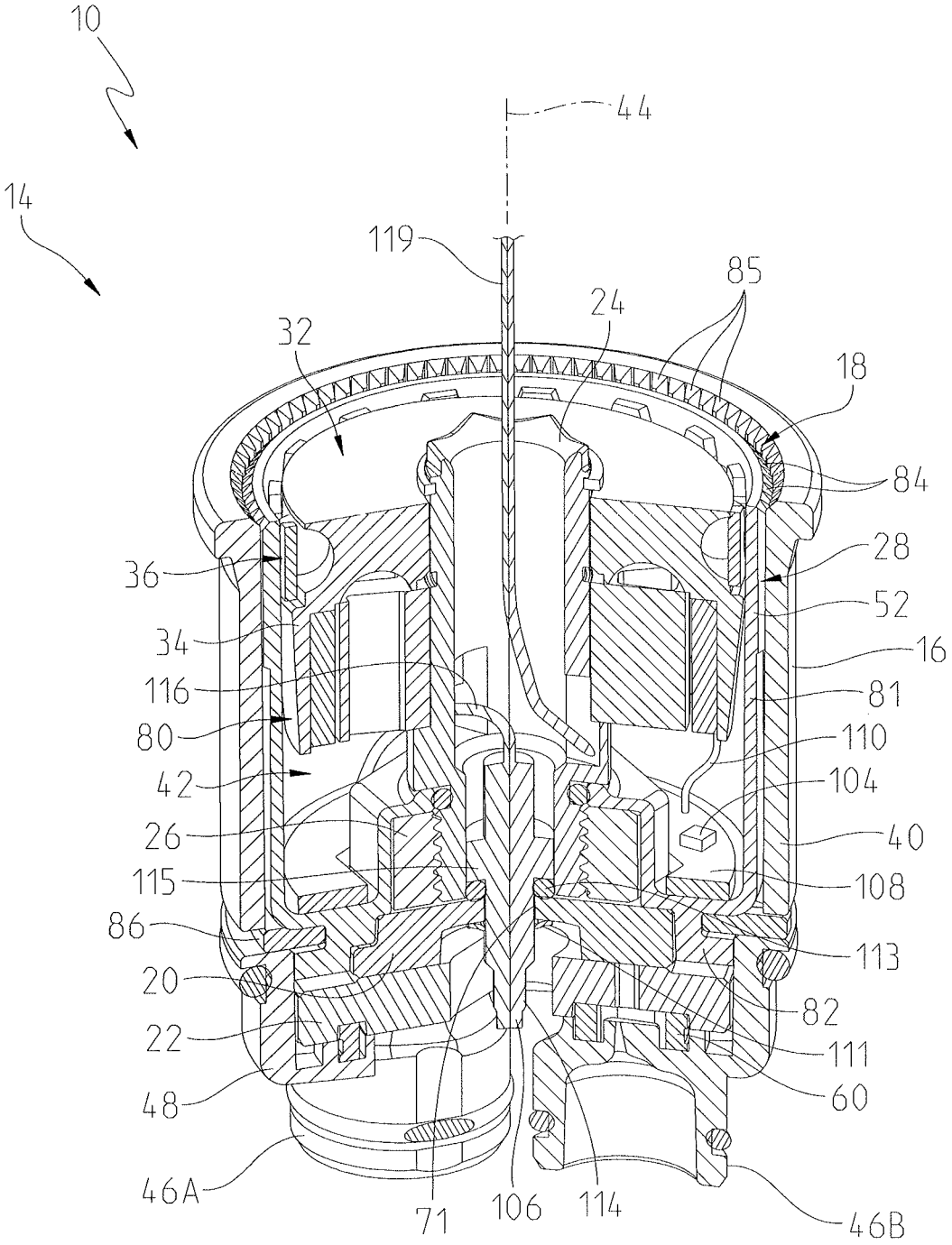
FIG. 5 is a longitudinal cross-sectional view taken along line 5-5 of FIG. 1.

As shown in FIG. 4, the outer housing 16 illustratively includes an outer sidewall 40 defining an internal chamber 42 extending along a longitudinal axis 44. A hot water inlet 46A and a cold water inlet 46B extend downwardly from an end wall or base 48. The hot water and cold water inlets 46A and 46B provide fluid communication between the internal chamber 42 and cooperating hot water and cold water ports 50A and 50B, respectively, formed in the valve body 12 (FIG. 1). The hot water and cold water ports 50A and 50B of the valve body 12 are in fluid communication with conventional hot water and cold water supplies (not shown).

In an illustrative embodiment, the inner gear assembly 18 comprises a strain wave or harmonic gearing system or assembly. As further detailed herein, the inner gear assembly 18 is illustratively defined by the outer housing 16, the motor assembly 28 (including the cam 34 of the rotor 32), and an inner flex gear 52, and is coaxially aligned along the longitudinal axis 44. Illustratively, the inner flex gear 52 is positioned intermediate the outer housing 16 and the rotor 32. As further detailed herein, the rotor 32 defines a wave generator cooperating with the inner flex gear 52.

With reference to FIGS. 3, 4, 5 and 7-9, the illustrative valve cartridge 14 includes flow control members 20 and 22 which may comprise cooperating ceramic valve plates or disks. As in a conventional faucet valve cartridge, the valve disks 20 and 22 rotate and seal against one another to mix incoming hot and cold water through the hot water and cold water inlets 46A and 46B. More particularly, the flow control members 20 and 22 are illustratively received within the chamber 42 of the outer housing 16, and include movable valve member or upper valve disk 20 sealingly engaging fixed valve member or lower valve disk 22. The lower valve disk 22 is supported by the end wall 48 of the outer housing 16 and is fixed from moving relative thereto. Hot and cold water inlet openings 54A and 54B extend through the lower valve disk 22 and are in fluid communication with the hot and cold water inlets 46A and 46B, respectively.

With reference to FIGS. 2A, 2B, 7 and 8, the lower valve disk 22 also includes an outlet opening 56 in fluid communication with an outlet port 58 of the valve body 12. A gasket 60 provides a fluid seal between the lower valve disk 22 and the end wall 48 of the outer housing 16. Notches 62 are illustratively formed in the outer edge of the lower valve disk 22 and receive tabs 64 extending upwardly from the end wall 48 of the outer housing 16 to rotationally locate and fix the lower valve disk 22 relative to the outer housing 16.

The upper valve disk 20 illustratively includes a lower surface 66 for sealingly engaging with an upper surface 68 of the lower valve disk 22. A flow control recess or passageway 70 is formed in the lower surface 66 of the upper valve disk 20 and provides for selective fluid communication between the hot and cold water inlet openings 54A and 54B and the outlet opening 56 of the lower valve disk 22. More particularly, as the upper valve disk 20 is rotated about its center axis 44, flow from the openings 54A and 54B (and therefore inlets 46A and 46B) to the outlet opening 56 varies, thereby controlling water flow rate and/or water temperature at the outlet opening 56. With further reference to FIG. 2B, the flow control recess 70 includes control edges 72A, 72B configured to selectively overlap with the hot and cold water inlet openings 54A and 54B of the lower valve disk 22 to control water flow from the hot water and cold water inlets 46A and 46B to the outlet opening 56. A center opening 71 extends through the upper valve disk 20.

The flow control members 20 and 22 illustratively define a cycling valve. More particularly, cycling valves are known to provide for the mixing of hot and cold water for delivery to an outlet. More particularly, outlet water temperature is increased when the valve disk 20 is rotated in a first direction to provide for an increased ratio of hot water to cold water, and outlet water temperature is decreased when the valve disk 20 is rotated in an opposite direction to provide for an increased ratio of cold water to hot water. Additional details of illustrative valve members defining a cycling valve are further detailed in U.S. Pat. Nos. 8,375,990 and 10,267,022, the disclosures of which are expressly incorporated by reference herein.

Figure 6:
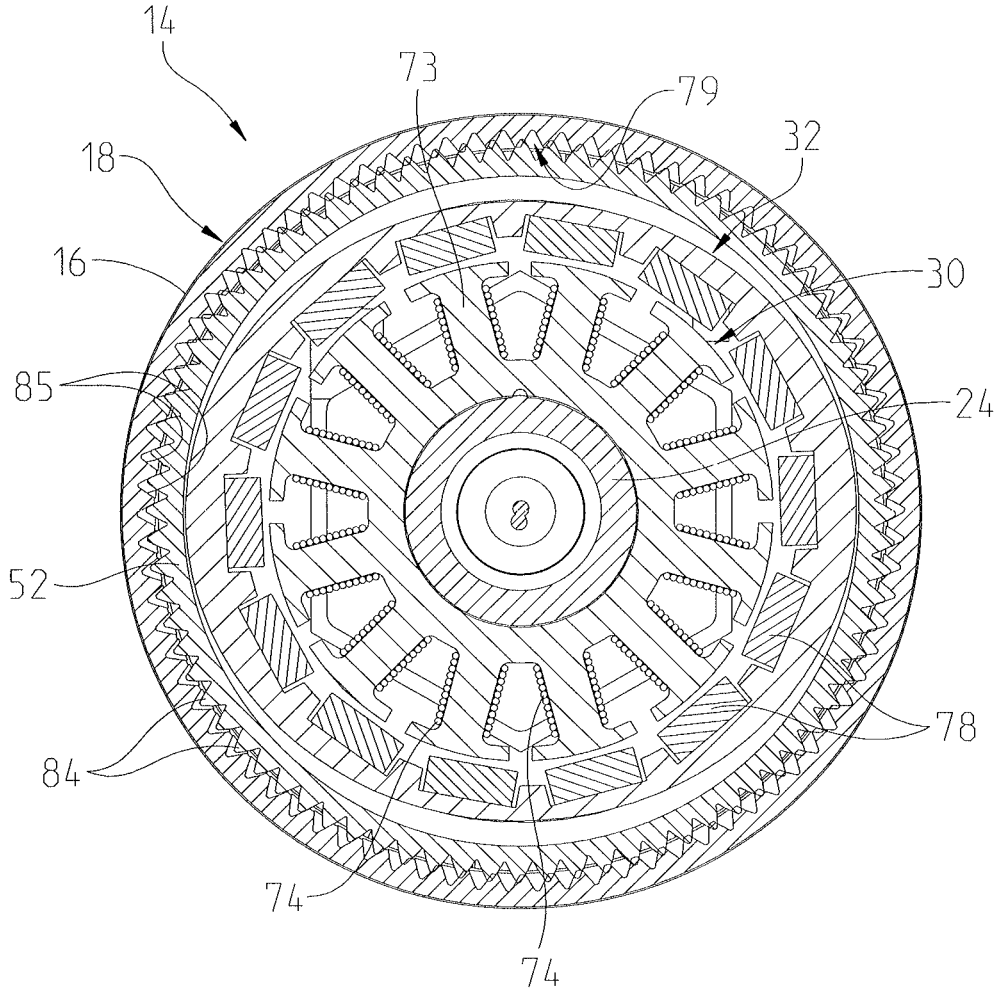
FIG. 6 is a lateral cross-sectional view taken along line 6-6 of FIG. 1.
Figure 7:
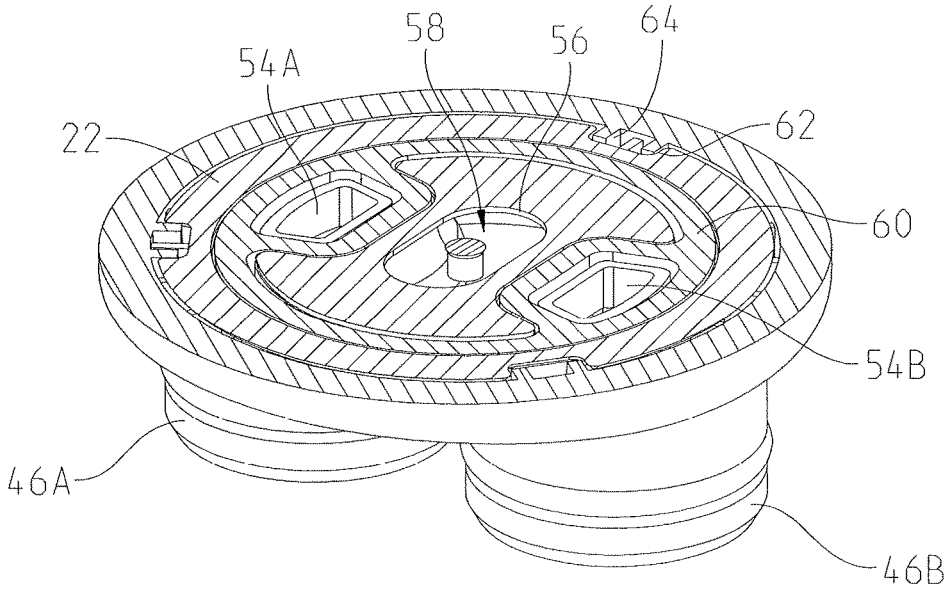
FIG. 7 is a lateral cross-sectional view taken along line 7-7 of FIG. 1.

As shown in FIGS. 4 and 6, the stator 30 is assembled to the flex gear 52 with the mounting nut 26. The stator 30 illustratively includes a center hub 73 wound with circumferentially spaced electrical wires or windings 74 to create an electromagnet which is the stationary component of the motor assembly 28. In an illustrative embodiment, the hub 73 may be formed of a polymer overmolded around the electrical windings 74 to provide corrosion protection from water/humidity and strain relief for the stator electrical windings 74. Illustratively, the electrical windings 74 are arranged in three separate groups such that the motor assembly 28 defines a three-phase brushless direct current (BLDC) motor.

Referring now to FIGS. 2A, 2B, 4 and 5, the rotor 32 is received within the internal chamber 42 of the outer housing 16, and is supported for rotation about the longitudinal axis 44 relative to the shaft 24. The rotor 32 illustratively includes a body 75 axially secured to the shaft by a retainer clip 76. The rotor 32 includes a plurality of circumferentially spaced magnets 78 supported by the body 75, and the bearing 36. The body 75 supports the oval or elliptical cam 34. The elliptical cam 34 contacts the inner flex gear 52 to drive the strain wave gear system 18. When an electrical control signal is applied to the electrical windings 74 of the stator 30, the magnets 78 cause the rotor 32 to rotate. The elliptical cam 34 cooperates with the inner flex gear 52 which, in turn, cooperates with the outer housing 16 to create the gear reduction needed to create the high torque required to rotate the upper valve disk 20 against the lower valve disk 22.

More particularly, the illustrative strain wave gear assembly 18 includes an outer circular spline 79 supported by the outer housing 16, the inner flex gear 52 cooperating with the outer circular spline 79, and a wave generator 80 supported for rotation about the longitudinal axis 44. Illustratively, the inner flex gear 52 is positioned intermediate the wave generator 80 and the outer circular spline 79 of the outer housing 16. The wave generator 80 is illustratively defined by the cam 34 of the rotor 32.

The inner flex gear 52 is illustratively cup-shaped and formed of a flexible material, such as an elastomer. The inner flex gear 52 illustratively includes a cylindrical sidewall 81 that is relatively thin and flexible, and a base 82 that is relatively rigid. Flex splines or external teeth 84 are circumferentially spaced, radially around the outside of the sidewall 81 of the inner flex gear 52. The inner flex gear 52 fits tightly over the wave generator 80, so that when the wave generator 80 is rotated, the inner flex gear 52 deforms to the shape of a rotating ellipse (i.e., cam 34). The bearing 36 allows the inner flex gear 52 to rotate independently to the wave generator 80.

The circular spline 79 of the outer housing 16 is illustratively a rigid circular ring with circumferentially spaced internal teeth 85. The inner flex gear 52 and the wave generator 80 are placed inside the outer circular spline 79, meshing the external teeth 84 of the inner flex gear 52 with the internal teeth 85 of the outer circular spline 79. Because the inner flex gear 52 is deformed into an elliptical shape, its teeth 84 only actually mesh with the teeth 85 of the circular spline 79 of the outer housing 16 in two locations on opposite sides of the inner flex gear 52 (located on the major axis of the ellipse). As further detailed below, the mismatch between the teeth 84 and 85 results in the inner flex gear 52 rotating relative to the outer housing 16.

Figure 2A:
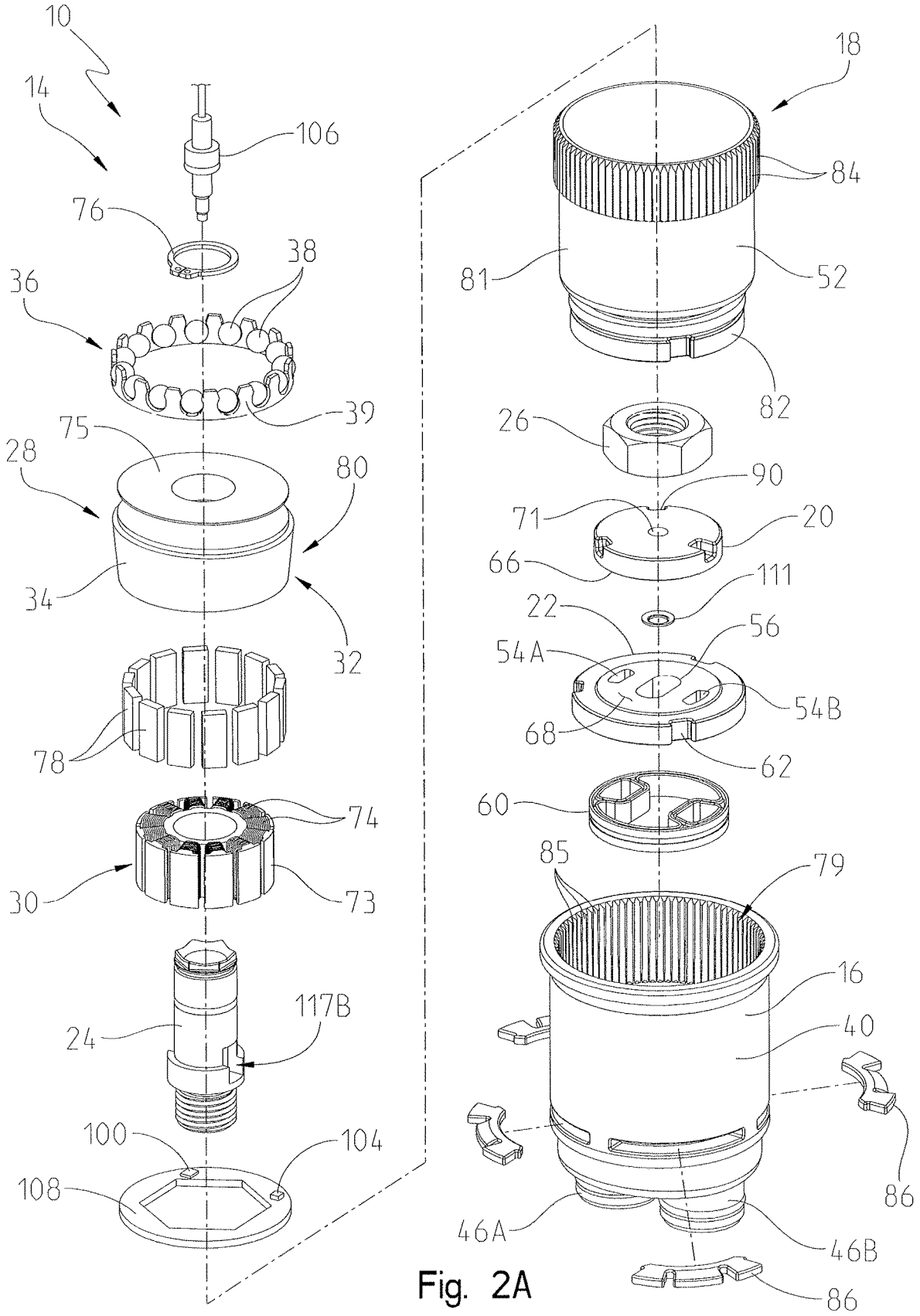
FIG. 2A is a top exploded perspective view of the illustrative valve assembly of FIG. 1.
Figure 2B:
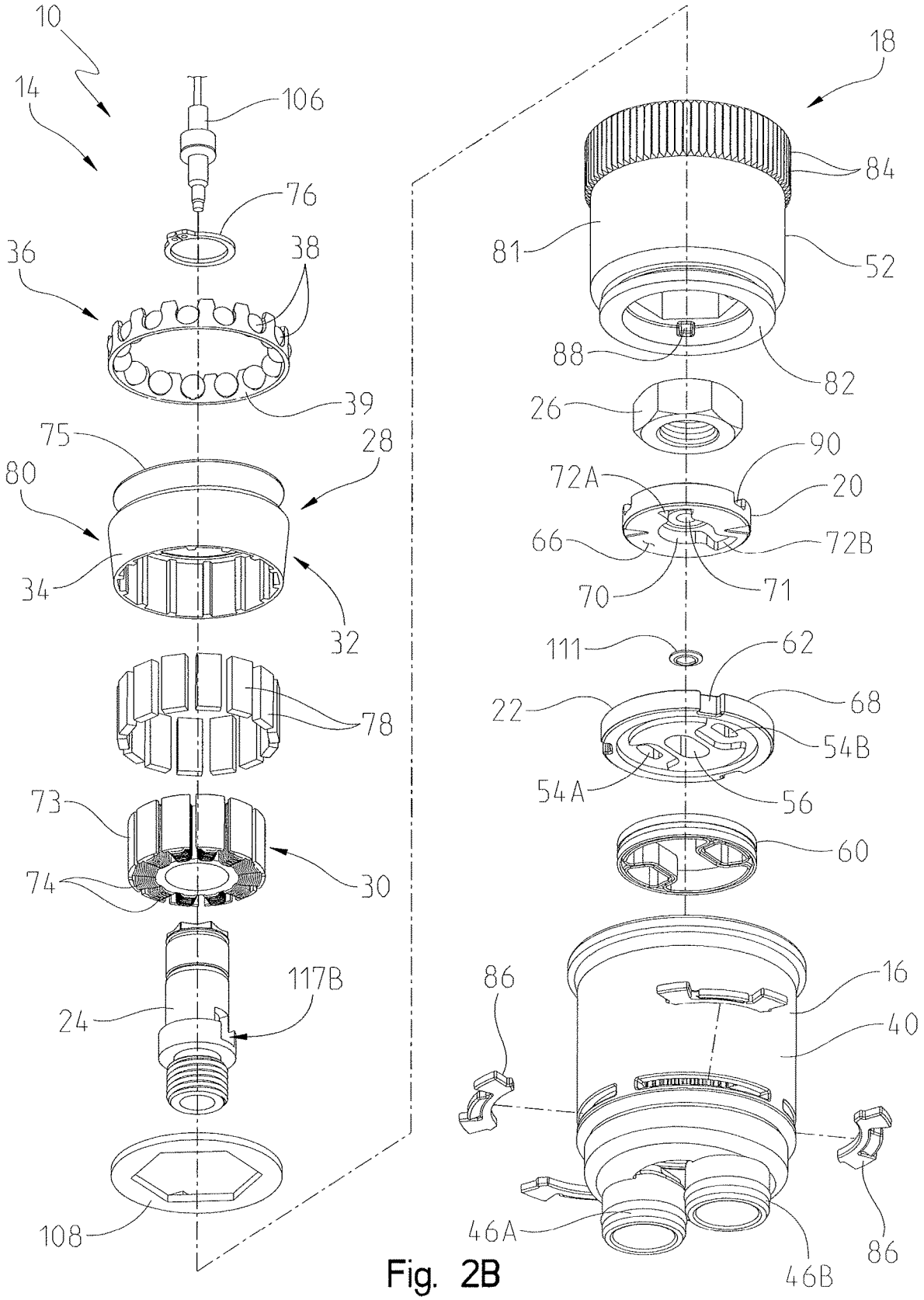
FIG. 2B is a bottom exploded perspective view of the illustrative valve assembly of FIG. 1.
Figure 3:
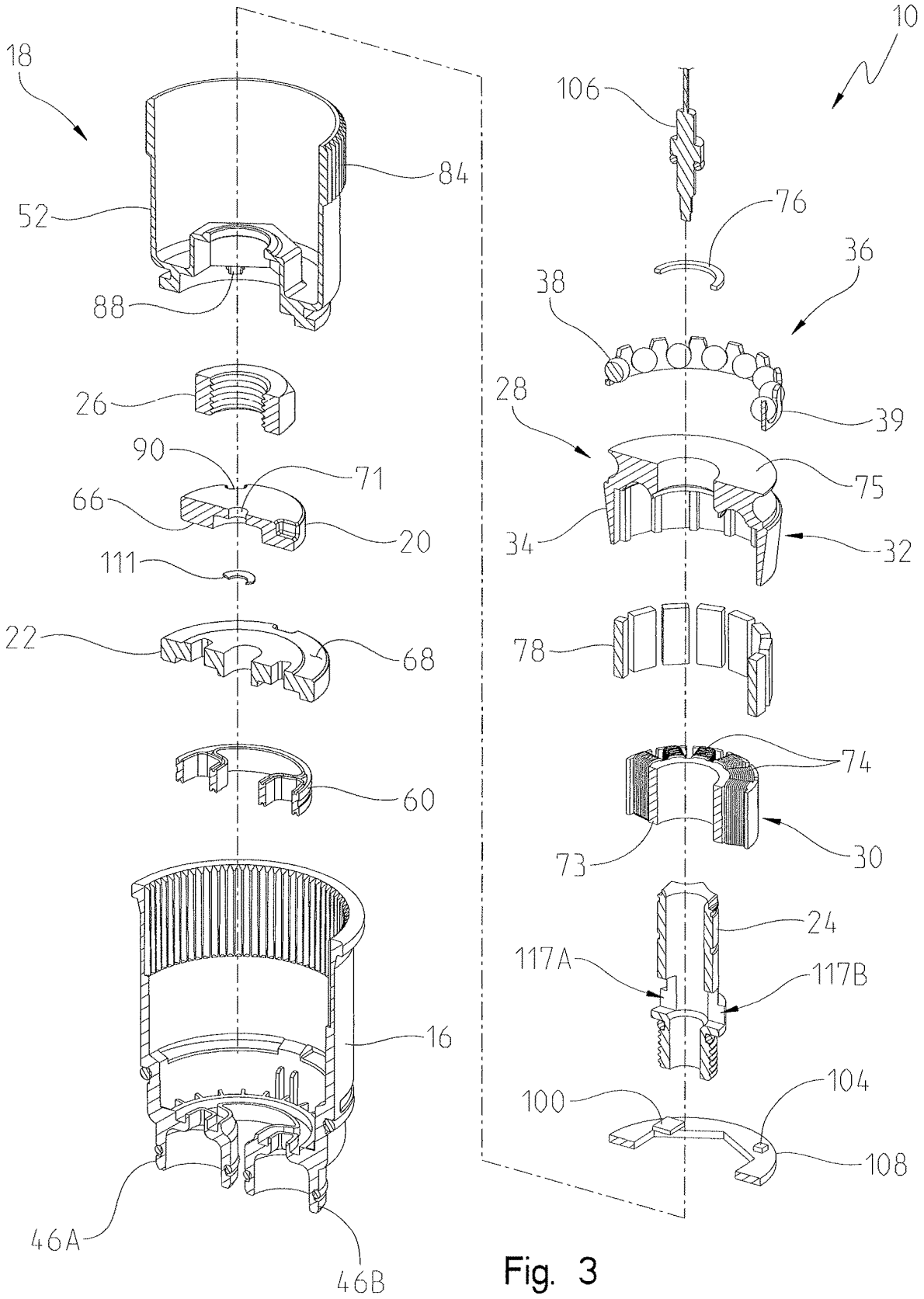
FIG. 3 is an exploded perspective view, in cross-section, of the illustrative valve assembly of FIG. 1.
Figure 8:
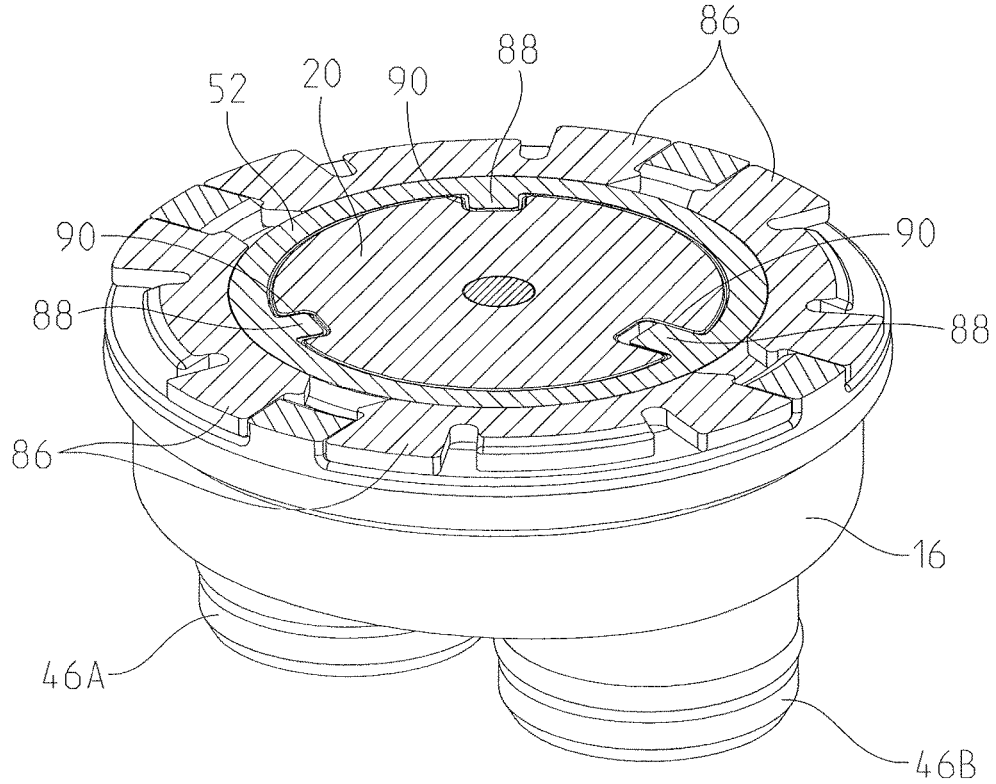
FIG. 8 is a lateral cross-sectional view taken along line 8-8 of FIG. 1.
Figure 9:
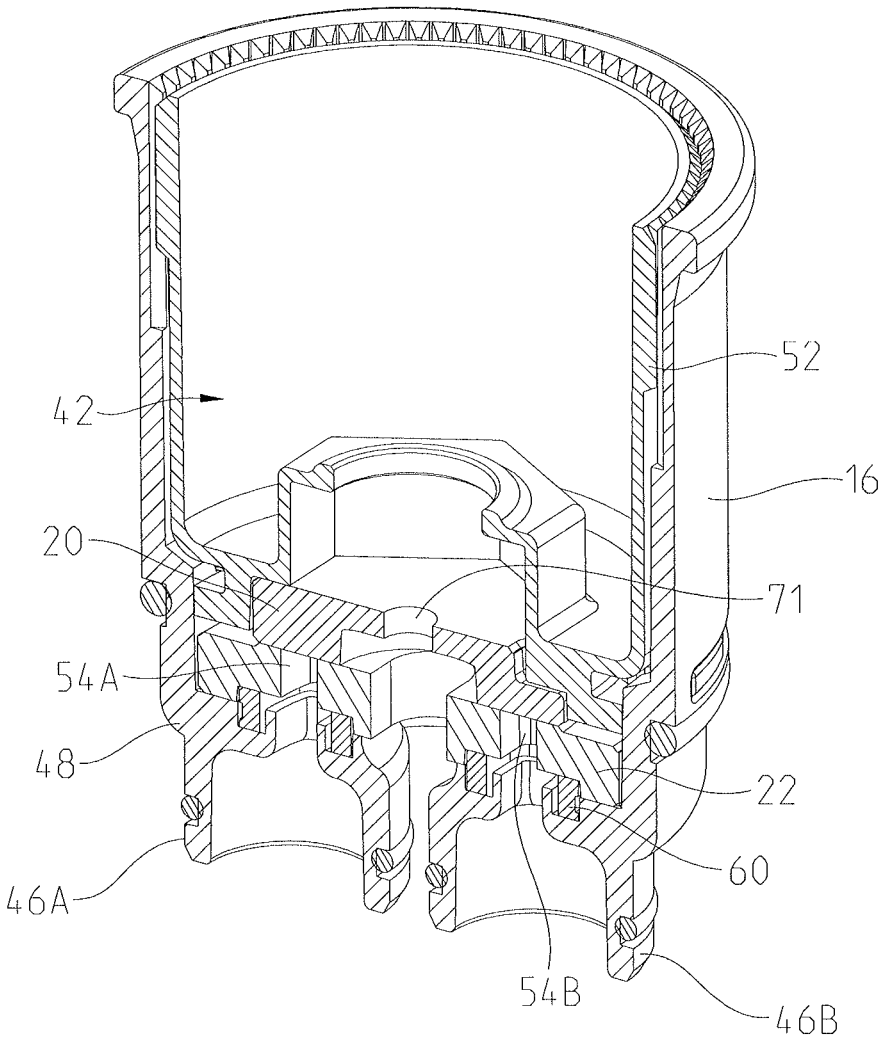
FIG. 9 is a longitudinal cross-sectional view of a valve plate assembly of the illustrative valve assembly of FIG. 1.
Figure 10:
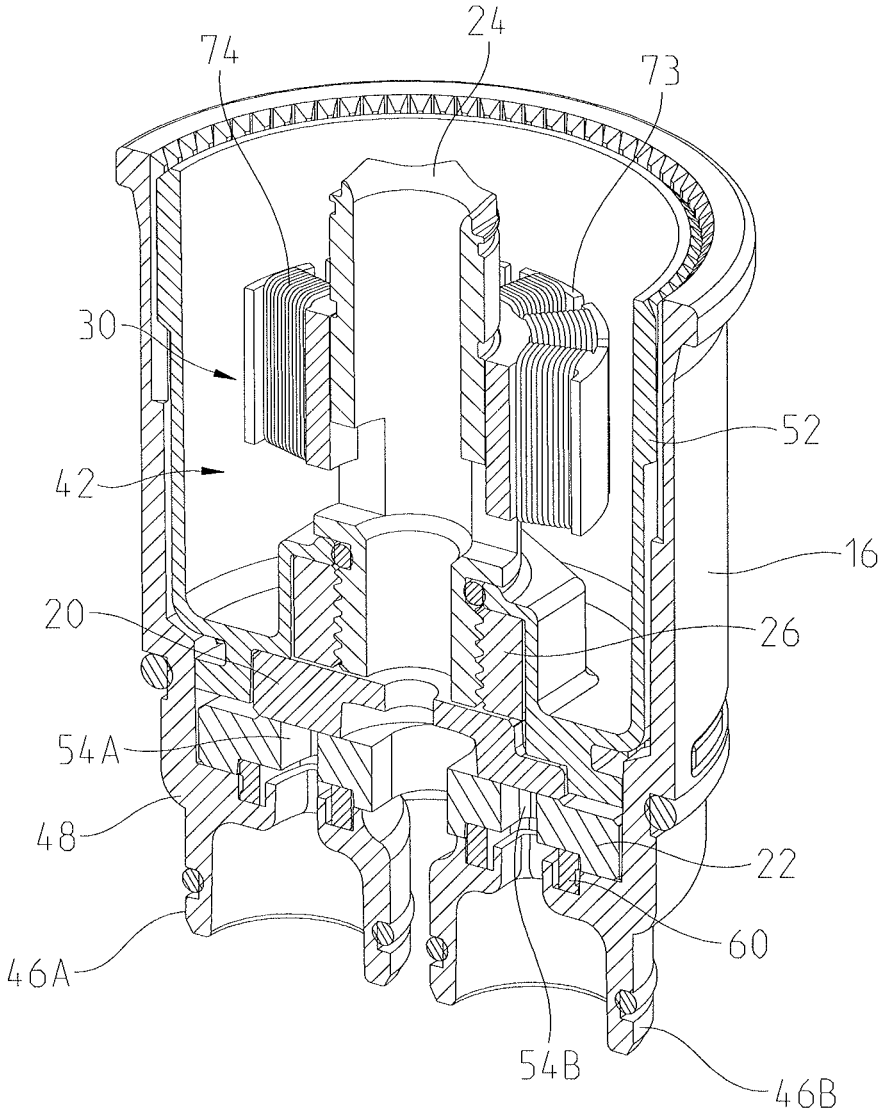
FIG. 10 is a longitudinal cross-sectional view of an illustrative stator assembly of the valve assembly of FIG. 1.
Figure 11:
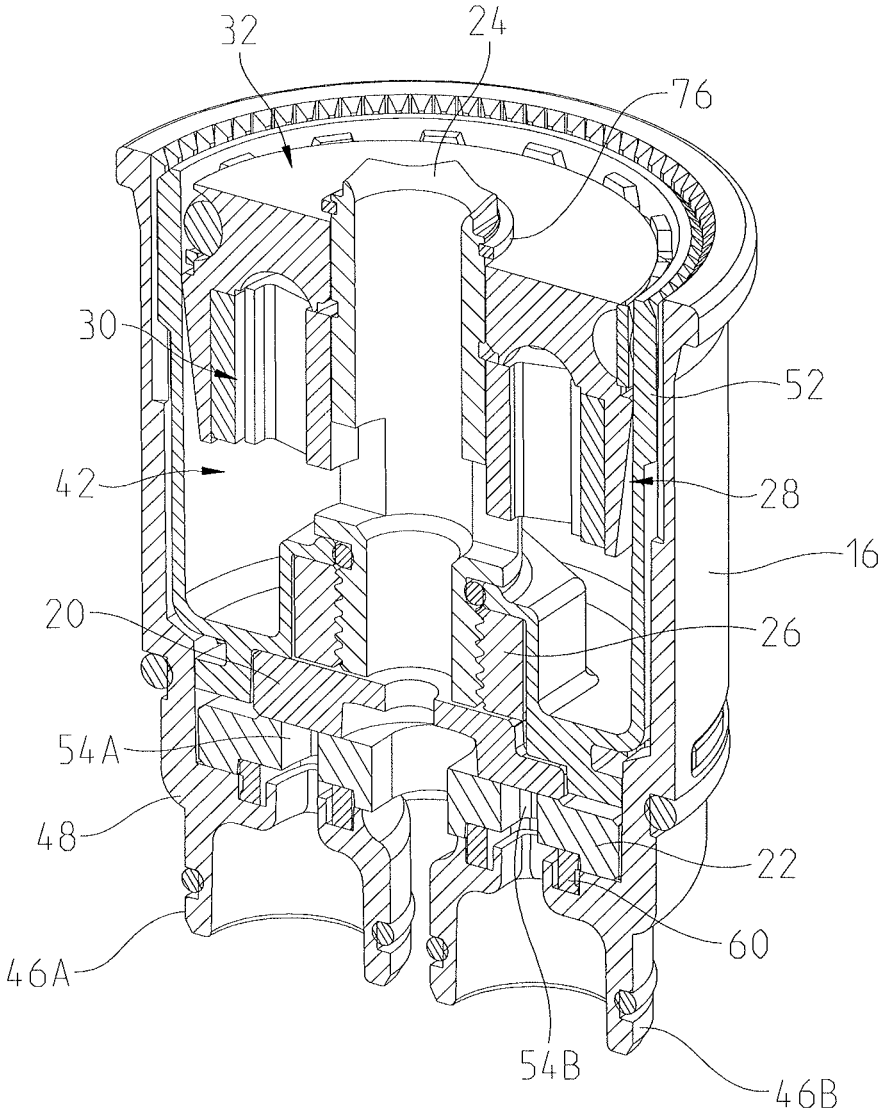
FIG. 11 is a longitudinal cross-sectional view of an illustrative rotor assembly of the valve assembly of FIG. 1.
Figure 12:
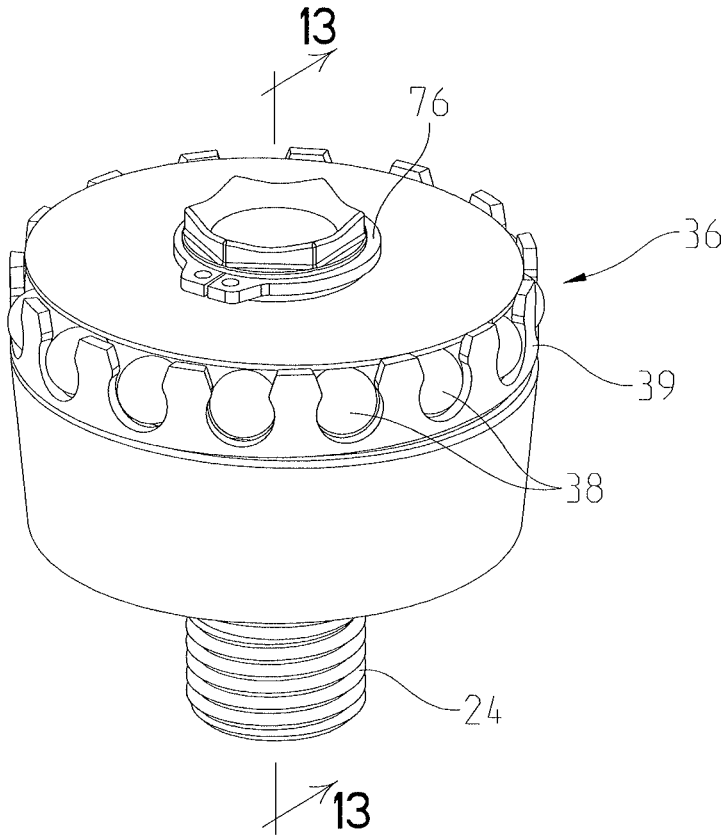
FIG. 12 is a perspective view of the illustrative rotor assembly of FIG. 11.
Figure 13:
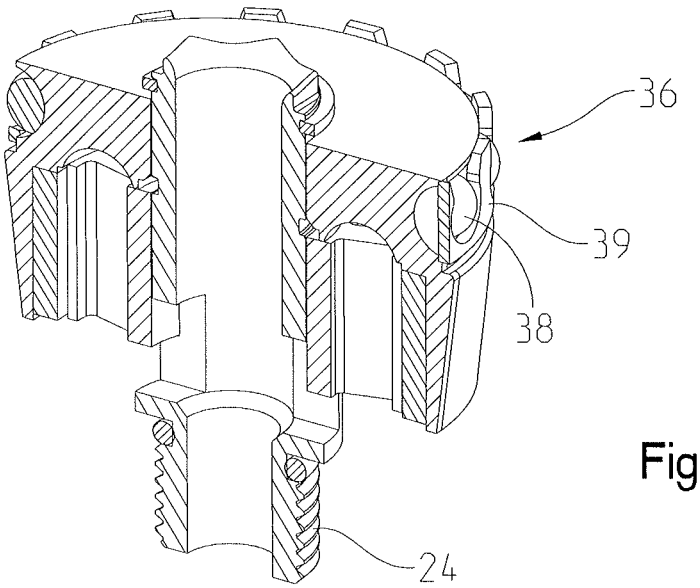
FIG. 13 is a longitudinal cross-sectional view taken along line 13-13 of FIG. 12.
Figure 14:
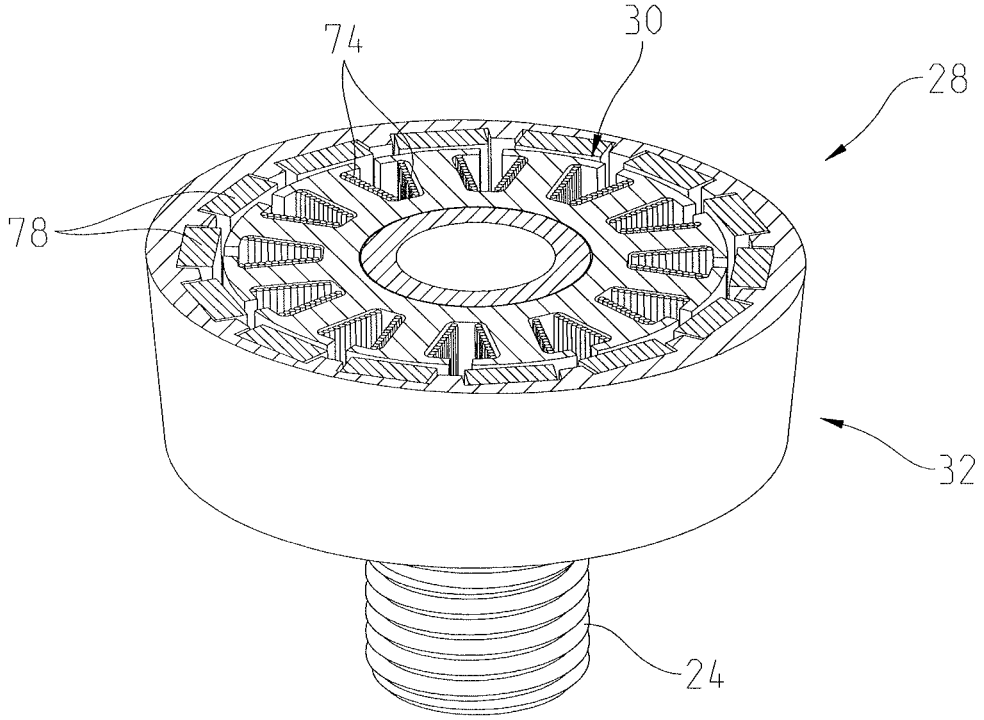
FIG. 14 is a lateral cross-sectional view taken along line 14-14 of FIG. 1.

With reference to FIGS. 2A, 2B and 8, the base 82 of the inner flex gear 52 is illustratively captured between the shaft 24 and the nut 26. More particularly, the inner flex gear 52 is rotatable about the shaft 24 but axially retained by the nut 26. Further, a plurality of circumferentially spaced retaining clips 86 further axially retain the inner flex gear 52 relative to the outer housing 16. The base 82 of the inner flex gear 52 includes circumferentially spaced tabs 88 that are received within slots 90 formed in the upper valve disk 20. As such, rotation of the base 82 of the inner flex gear 52 also causes rotation of the upper valve disk 20 relative to the lower valve disk 22.

As the wave generator 80 (e.g., cam 34 of rotor 32) rotates, the external teeth 84 of the inner flex gear 52, which are meshed with the internal teeth 85 of the outer circular spline 79, slowly change position. The major axis of the inner flex gear's 52 ellipse rotates with wave generator 80, so the points where the teeth 84 and 85 mesh revolve around the center point at the same rate as the wave generator 80. The key to the design of the strain wave gear assembly 18 is that there are fewer teeth 84 (often for example two fewer) on the inner flex gear 52 than there are teeth 85 on the circular spline 79. This means that for every full rotation of the wave generator 80, the inner flex gear 52 is required to rotate a slight amount (two teeth in this example) backward relative to the circular spline 79 of the outer housing 16. Thus, the rotation action of the wave generator 80 results in a much slower rotation of the inner flex gear 52 in the opposite direction.

For a strain wave gearing mechanism, the gearing reduction ratio can be calculated from the number of teeth 84, 85 on each gear:

Reduction ratio=(number of inner flex spline teeth 84−number of outer circular spline teeth 85)/number of inner flex spline teeth 84

In the illustrative embodiment, there are 92 outer circular spline teeth 85 on the outer circular spline 79, and 90 inner flex spline teeth 84 on the inner flex gear 52, such that the reduction ratio is (90−92)/90=−0.02.

Thus the inner flex gear 52 of the present disclosure spins at 2/100 the speed of the wave generator 80 and in the opposite direction. Different reduction ratios are set by changing the number of teeth. This can be achieved by changing the mechanism's diameter or by changing the size of the individual teeth and thereby preserving its size and weight. The range of possible gear ratios is limited by tooth size limits for a given configuration.

In another illustrative embodiment, the inner gear assembly 18 may be defined by a planetary gear system. In such a configuration, a stator may drive a rotor in rotation wherein one or more outer, or planet, gears or pinions, revolve around a central sun gear or wheel. The planet gears may be mounted on a movable arm or carrier, which itself may rotate relative to the sun gear. In such an arrangement, the motor, as defined by the stator and the rotor, and the inner gear assembly are coaxially aligned with the longitudinal axis 44 of the housing 16.

Figure 15:
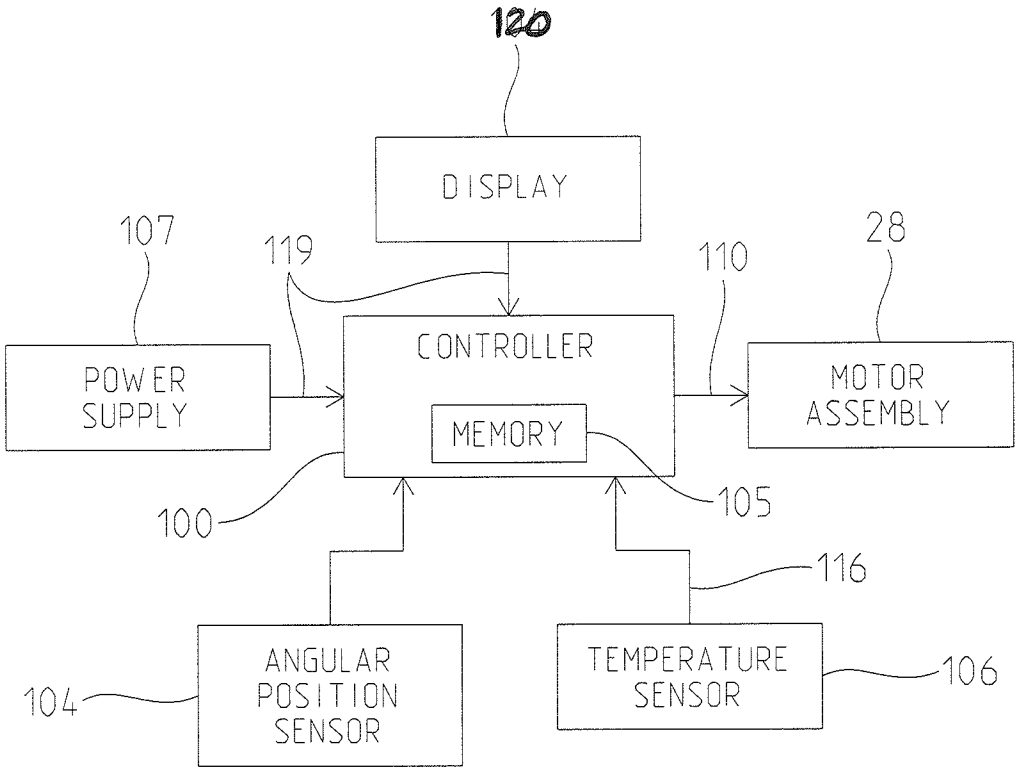
FIG. 15 is a block diagram of electrical components of the illustrative valve assembly of FIG. 1.
Figure 17:
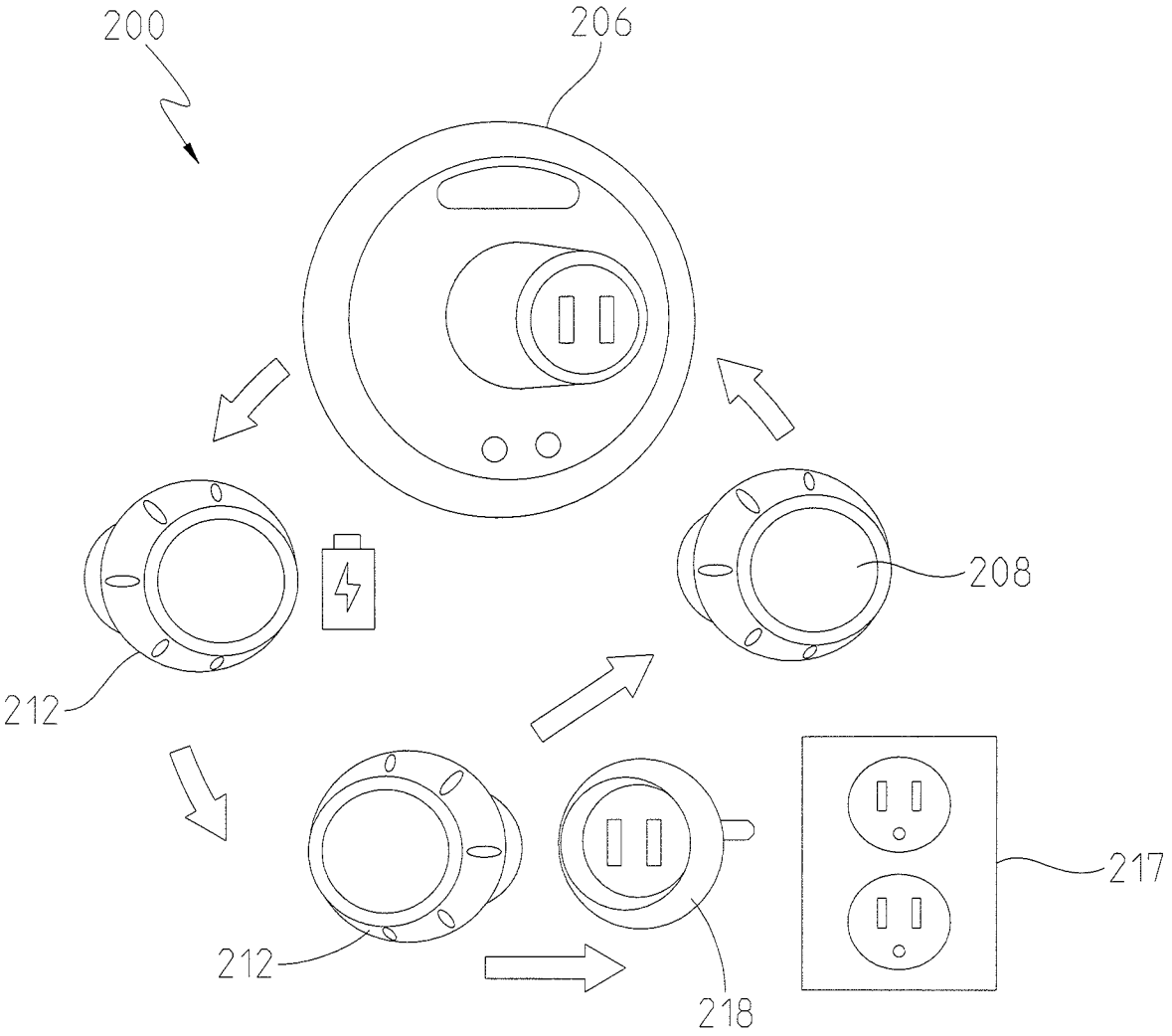
FIG. 17 is another perspective view of the shower system of FIG. 16.

With reference to FIGS. 15 and 17, a controller 100 (e.g., a microprocessor) is provided to control operation of the motor assembly 28 in response to various inputs, including input from a user interface 102, an angular position sensor 104, and/or a temperature sensor 106. The controller 100 may be supported by a printed circuit board 108 received with the valve cartridge 14 or may be positioned external thereto. The controller 100 may include a memory 105 and is in communication with the motor assembly 28. A power supply 107 is illustratively in electrical communication with the controller 100 and is configured to provide selective power to the motor assembly 28.

The controller 100 is operably coupled to the motor assembly 28 via an electrical wire or cable 110 to the circuit board 108 to move the valve disk 20. More particularly, the controller 100 sends an electrical signal to the stator 30 to drive the rotor 32 in rotation, wherein the cam 34 drives the inner flex gear 52 in rotation which, in turn, rotates the valve disk 20 to control water flow through the water inlets 46A and 46B to the outlet port 58. Illustratively, the motor assembly 28 defines a brushless direct current (BLDC) motor.

The angular or rotational position sensor 104 is in communication with the controller 100 and is configured to provide an indication of the rotational position of the valve disk 20 at any point in time. The angular position sensor 104 may be of conventional design, such as a Hall Effect sensor cooperating with a magnet, or a rotary potentiometer.

In alternative embodiments, the angular position sensor 104 is not required to control the motor assembly 28. In such embodiments, the motor assembly 28 may be controlled in a manner similar to a stepper motor. Without the position sensor 104, it must be assumed that the motor assembly 28 is moved to where it is commanded to move by the controller 100. Illustratively, end stops would be positioned between the external teeth 84 and the housing 16 that correspond to OFF and FULL HOT valve positions. Each time the valve is turned off, it will be moved to the end stop which provides a reference position for "homing". The homing could optionally only be performed upon initial power application, but homing on every use eliminates "drift" that could occur over time due to "missed steps".

Figure 16:
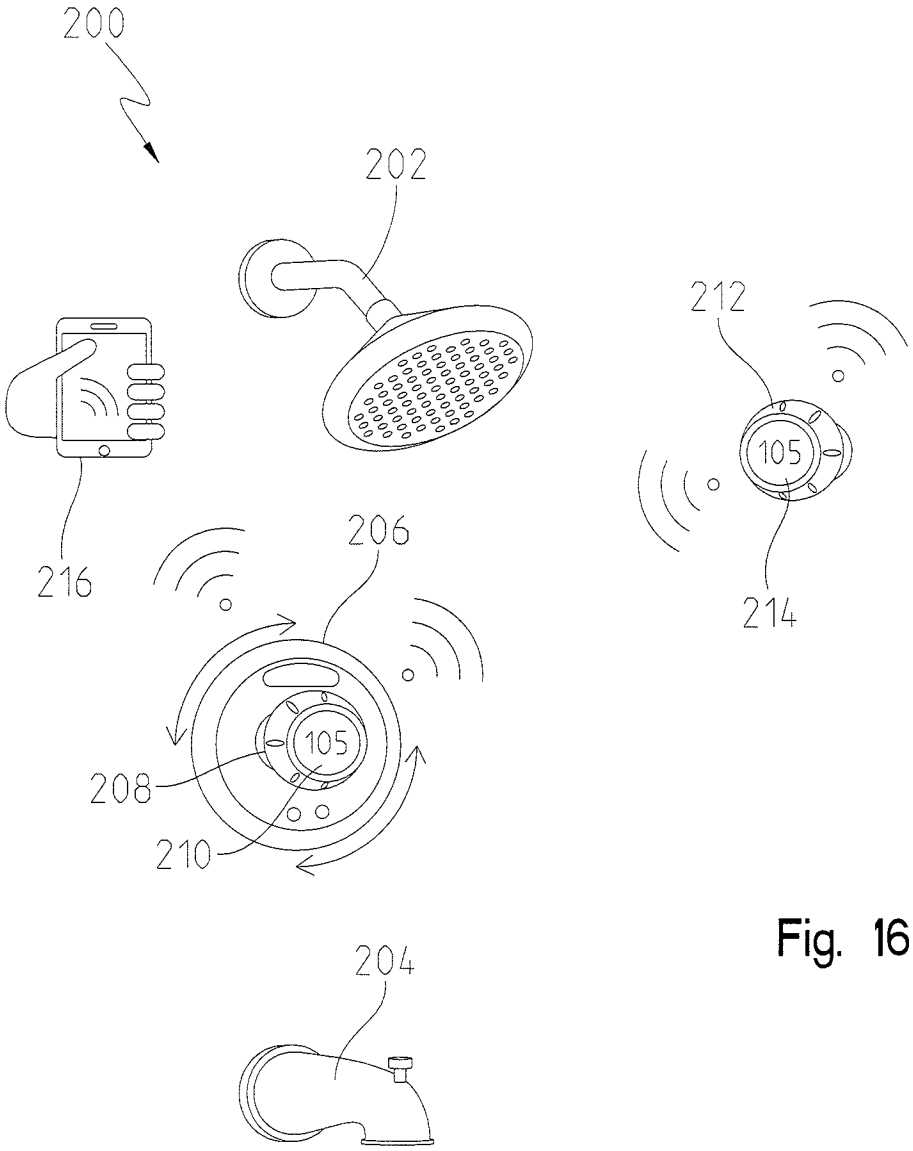
FIG. 16 is a perspective view of an illustrative shower system according to the present disclosure.

As shown in FIGS. 16 and 17, the illustrative valve cartridge 14 includes the water temperature sensor 106, illustratively a thermistor, in communication with the controller 100. The temperature sensor 106 monitors the output temperature of the output water (passing through outlet opening 56) thereby providing feedback needed to properly mix the water within the valve cartridge 14. More particularly, the thermistor 106 may provide an indication of the temperature of water at outlet opening 56 to the controller 100 for display on the user interface 102, and/or for adjusting the position of the valve disk 20 to control the temperature of water at outlet opening 56 to match a setpoint or user preset temperature. The thermistor 106 is received within the opening 71 of the upper valve disk 20 and retained by a clip 111. An o-ring 113 is received between a flange 115 on the thermistor 106 and the upper valve disk 20. The thermistor 106 illustratively includes a sensing portion or probe 114 within the water flow, and a wire 116 extending through a longitudinal passageway 121 and a side or radial opening 117A of the shaft 24 to provide electrical communication between the sensing portion 114 and the controller 100.

A mixing device (not shown) may be provided to facilitate mixing of hot water and cold water for temperature measurement by the thermistor 106. For example, the mixing device may include a screen covering the probe 114 of the thermistor 106. Holes in the screen would be perpendicular to the water flow, so the water will start out jetting by the holes. Once the chamber 42 fills up, back pressure and turbulence will force the water through the holes in the screen. As the water jets through the screen, water mixing will be facilitated.

The user interface 102 is illustratively in communication with the controller 100. Illustratively, an electrical wire or cable 119 extends from external to the valve cartridge 10 through the longitudinal passageway 121 and the radial opening 117B of the shaft 24 to the circuit board 108. The cable 119 illustratively electrically couples the power supply 107 and the display 120 to the printed circuit board 108. In turn, electrical traces on the printed circuit board 108 electrically couple the cable 119 to the controller 100. Electrical traces on the printed circuit board 108 illustratively couple the controller 100 to the angular position sensor 104. Similarly, electrical traces on the printed circuit board 108 and the electrical stator wires 110 electrically couple the cable 119 to the electrical windings 74 of the stator 30. Electrical traces on the printed circuit board 108 and the electrical thermistor wire 116 couple the controller 100 to the temperature sensor 106. The thermistor wire 116 extends from the thermistor 106 into the longitudinal passageway 121 and out of the radial opening 117A of the shaft 24.

In a further illustrative embodiment, the controller 100 and/or the printed circuit board 108 may be positioned external to the valve cartridge 10. In such an embodiment, the stator wires 110 and the thermistor electrical wire 116 would combine together after extending into the passageway 112 of the shaft 24 and terminate in an electrical pin connector (not shown), which coupled to an external controller 100.

The user interface 102 may include a sealed display 120 including input regions or buttons, and an output region. Multiple displays 120 may be provided to control the valve cartridge 10. Once paired with the user interface 102, a use will be able to control the shower valve with a push of a button or dial in the shower, with a remote (via phone, tablet, etc.), and/or by using an application (app) on a smart device.

One or more of the electronic components described above may be part of a user interface device that detachably couples to other components of the electronic valve cartridge 14. For example, the controller 100, the memory 105, the display 120, and the power supply 112 may be part of a user interface device that detachably couples to other components of the electronic valve cartridge. Examples of such user interface devices are described in further detail below.

With reference to FIG. 16, an illustrative shower system 200 is illustrated. The shower system 200 includes an electronic valve assembly (not shown), such as the electronic valve cartridge 14 (shown elsewhere). The electronic valve assembly illustratively directs water to a showerhead spout 202 and a tub spout 204. In other embodiments, the electronic valve assembly may direct water to a different combination of showerheads and tub spouts, such as a single showerhead spout or a single tub spout.

The shower system 200 also includes an escutcheon 206 that obscures the electronic valve assembly and selectively attachably and detachably carries a first user interface device 208. The user interface device 208 operatively couples to the electronic valve assembly (for example, via wired or wireless communication, such as Wi-Fi, Bluetooth, etc.). The user interface device 208 includes one or more displays to present system information to a user. Illustratively, the user interface device 208 includes a single electronic display 210 (such as an LCD display) to present system information (such as water temperature and power status of the user interface device 208). Specific examples of information provided by the display are described below.

The display may also act as a user input (for example, the displays may be touch-responsive), and/or the user interface device 208 may include one or more separate user inputs (not shown). In either case, the user input may be manipulated to control system features, such as water flow and/or temperature. Specific examples of system features that may be controlled by the user input are described below.

The user interface device 208 further includes one or more power supplies (not shown—for example, rechargeable batteries) for powering the user interface device 208 and/or the electronic valve assembly (for example, wirelessly, via inductive power transmission). This aspect of the user interface device 208 is described in further detail below.

Illustratively, the shower system 200 further includes a second user interface device 212, which may have the same or similar features as the first user interface device 208. Illustratively, the second user interface device 212 is shown disposed apart from the escutcheon 206, although the second user interface device 212 may be selectively attachable to and detachable from the escutcheon 206. That is, the second user interface device 212 and the first user interface device 208 may be interchangeably carried by the escutcheon 206. The second user interface device 212 operatively couples to the first user interface device 208 and/or the electronic valve assembly (for example, via wireless communication, such as WiFi, Bluetooth, etc.). Illustratively and similarly to the first user interface device 208, the second user interface device 212 includes one or more displays to present system information to a user. Illustratively, the second user interface device 212 includes a single electronic display 214 (such as an LCD display) to present system information. The display may also act as a user input, and/or the second user interface device 212 may include one or more separate user inputs (not shown). In either case, the user input may be manipulated to control system features, such as water flow and/or temperature. The second user interface device 212 further includes one or more power supplies (not shown—for example, rechargeable batteries) for powering the second user interface device 212 and/or the electronic valve assembly.

Illustratively, the first user interface device 208, the second user interface device 212, and/or the electronic valve assembly may operatively couple to a smart device 216 (for example, via wireless communication, such as Wi-Fi, Bluetooth, etc.) to facilitate control of the shower system 200 and/or present system information via an app on the smart device 216.

Figure 19:
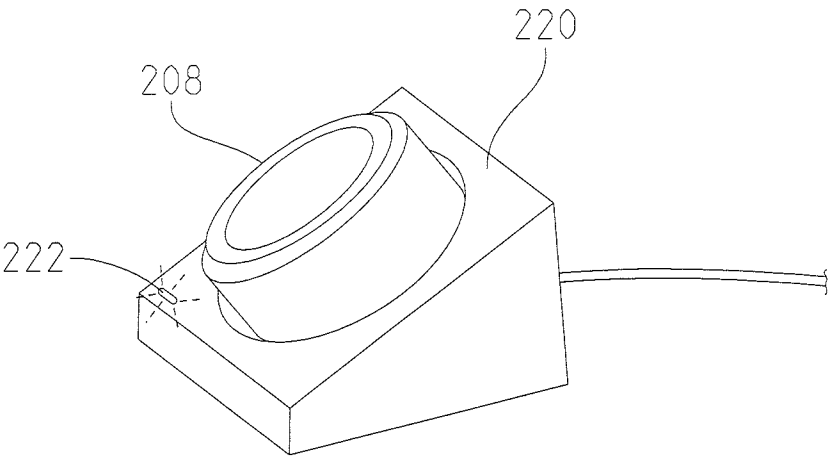
FIG. 19 is a perspective view of the user interface device coupled to the charging dock of FIG. 16.

With reference to FIG. 17, the shower system 200 is further illustrated. More specifically, FIG. 19 illustrates interchangeability of the first user interface device 208 and the second user interface device 212. Illustratively, a power-depleted user interface device (for example, the second user interface device 212) may be detached from the escutcheon 206 and coupled to a power source (for example, an AC outlet 217 via a charging dock or adapter 218) to recharge the power supply of the user interface device. Meanwhile, a charged user interface device (for example, the first user interface device 208) may be attached to the escutcheon 206 to control the shower system 200. Additionally, the other user interface device, once sufficiently charged, may remotely control the shower system 200.

Figure 18:
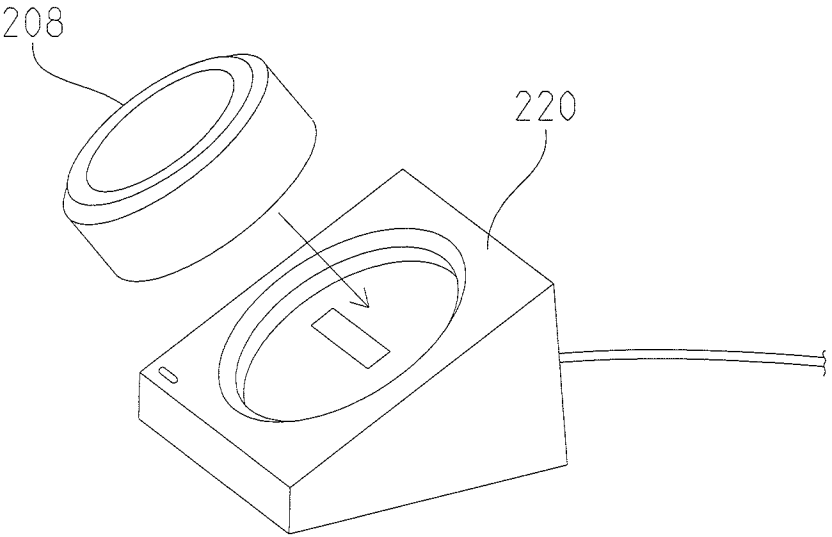
FIG. 18 is a perspective view of a user interface device of the shower system of FIG. 18 being coupled to a charging dock.
Figure 20A:
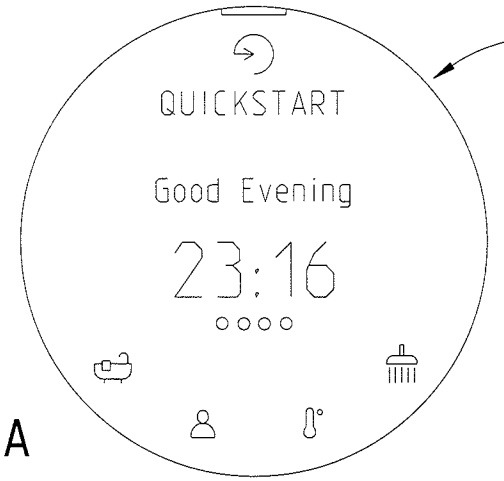
FIGS. 20A-20D are exemplary screens of an illustrative user interface provided by a display according to the present disclosure.
Figure 20B:
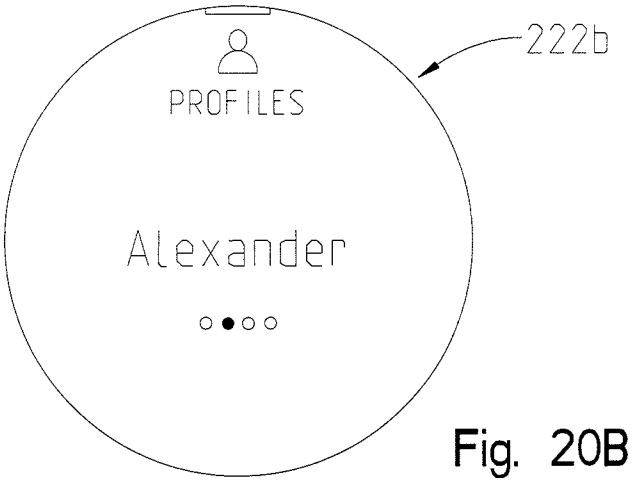
Figure 20C:
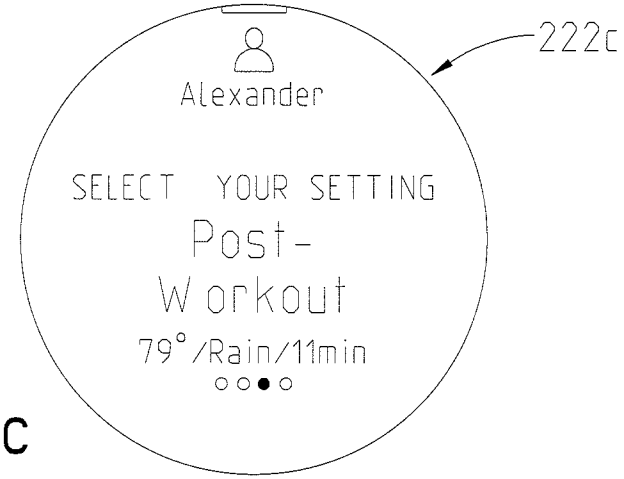
Figure 20D:
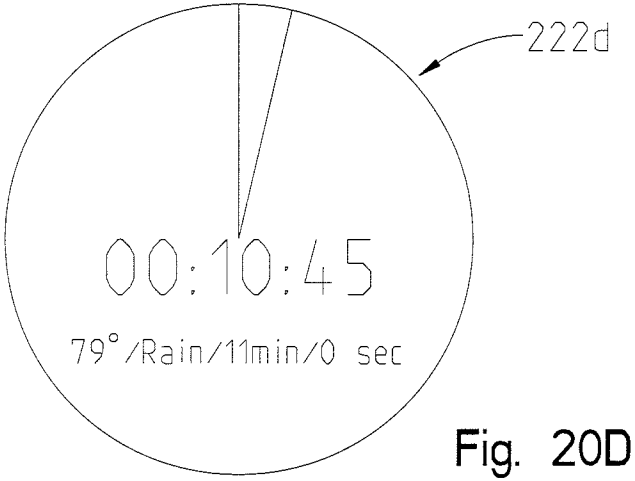
Figure 21B:
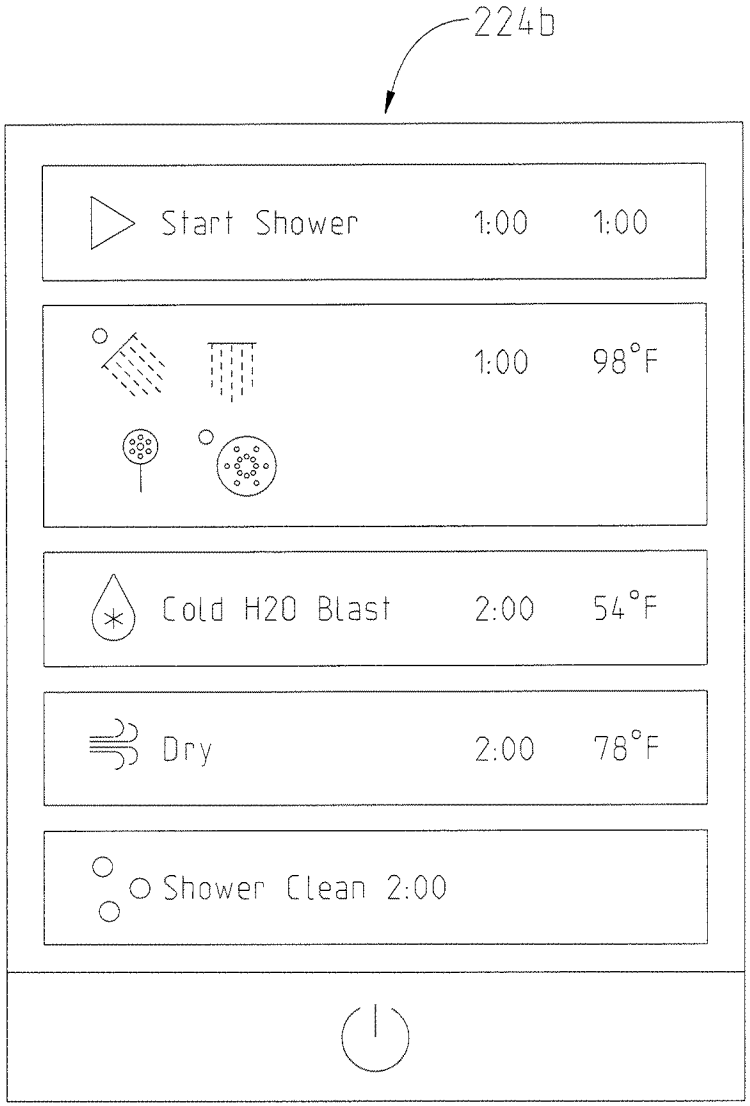
FIGS. 21A-21E are exemplary screens of another illustrative user interface provided by a display according to the present disclosure.
Figure 21A:
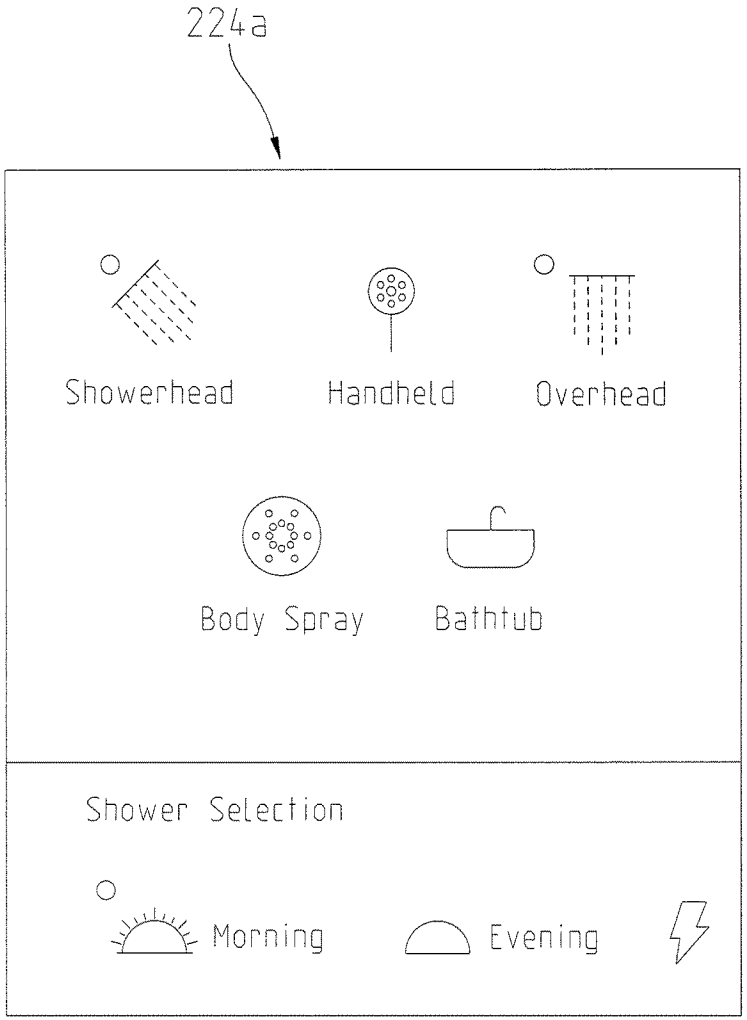
Figure 21D:
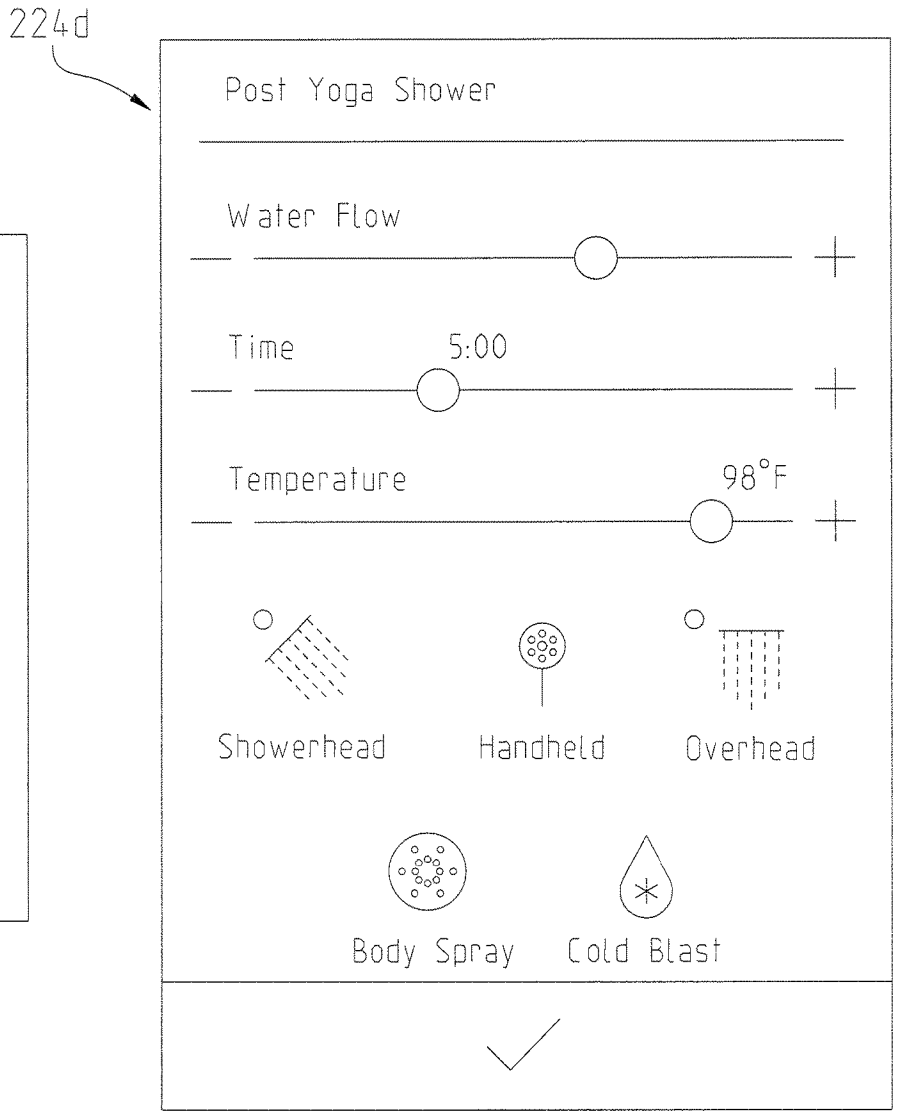
Figure 21C:
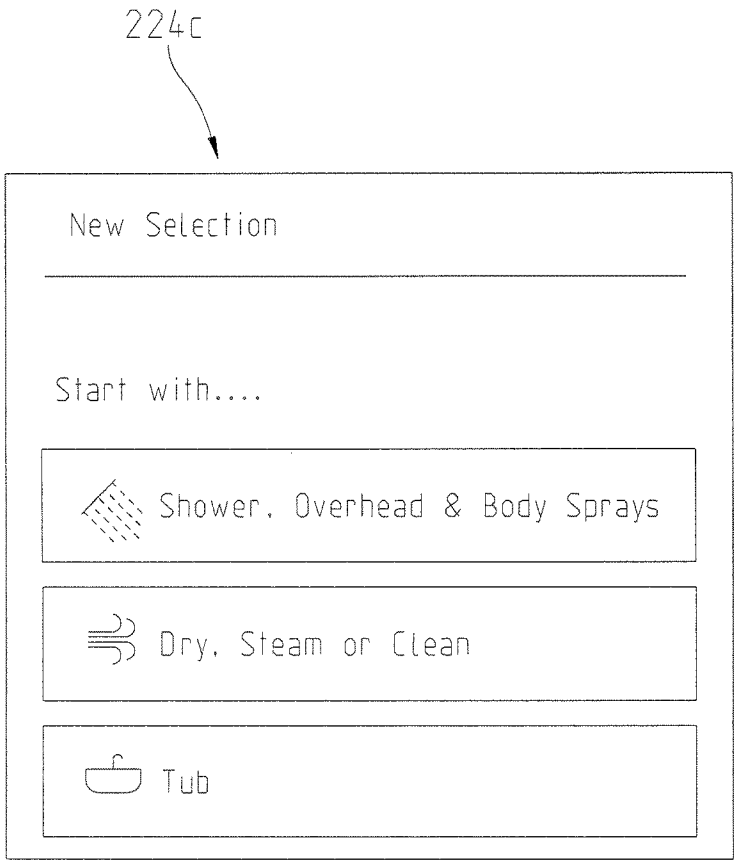
Figure 21E:
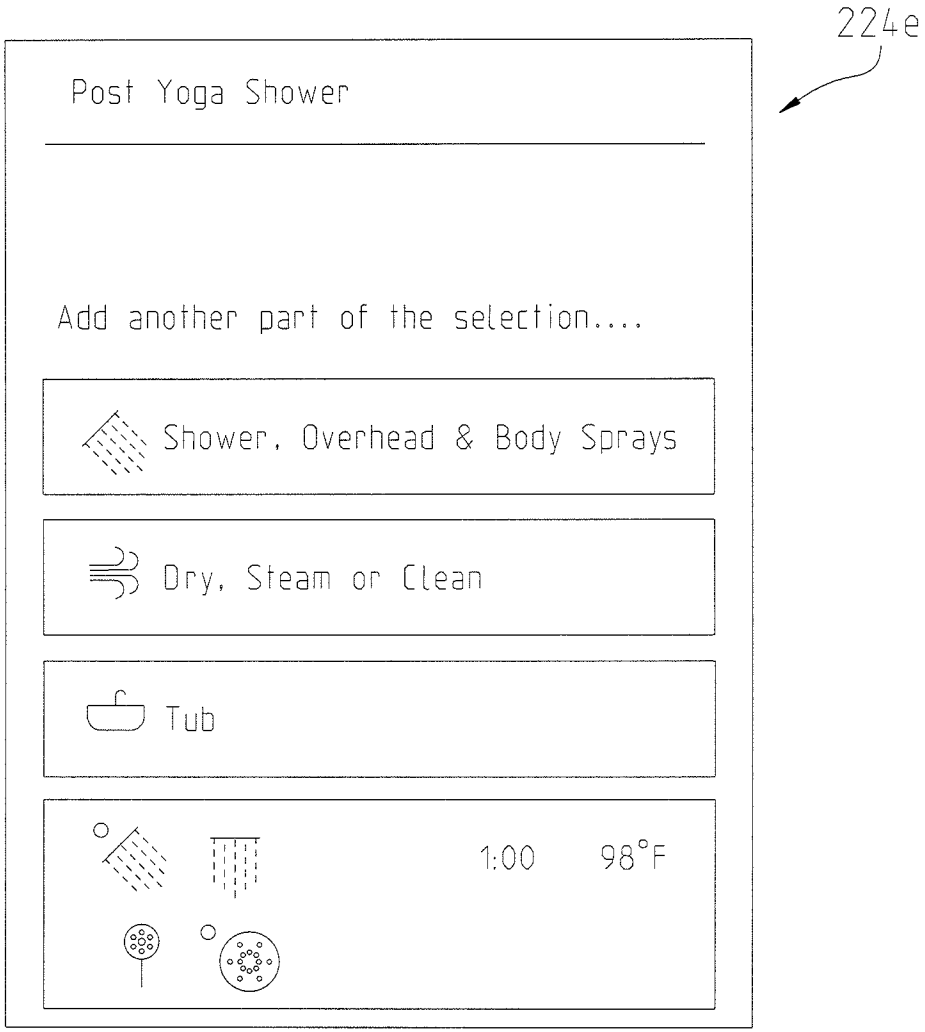
Figure 23:
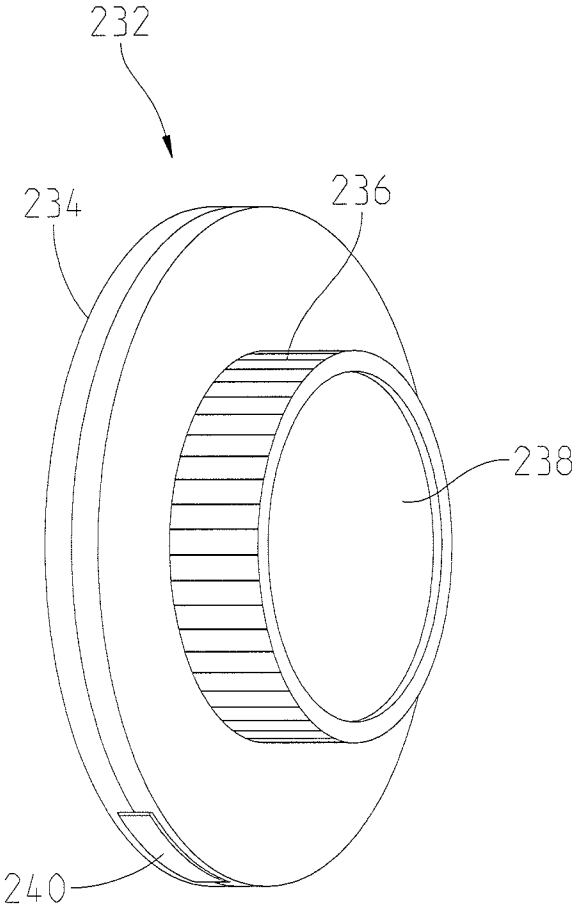
FIG. 23 is another perspective view of the escutcheon assembly of FIG. 22.
Figure 22:
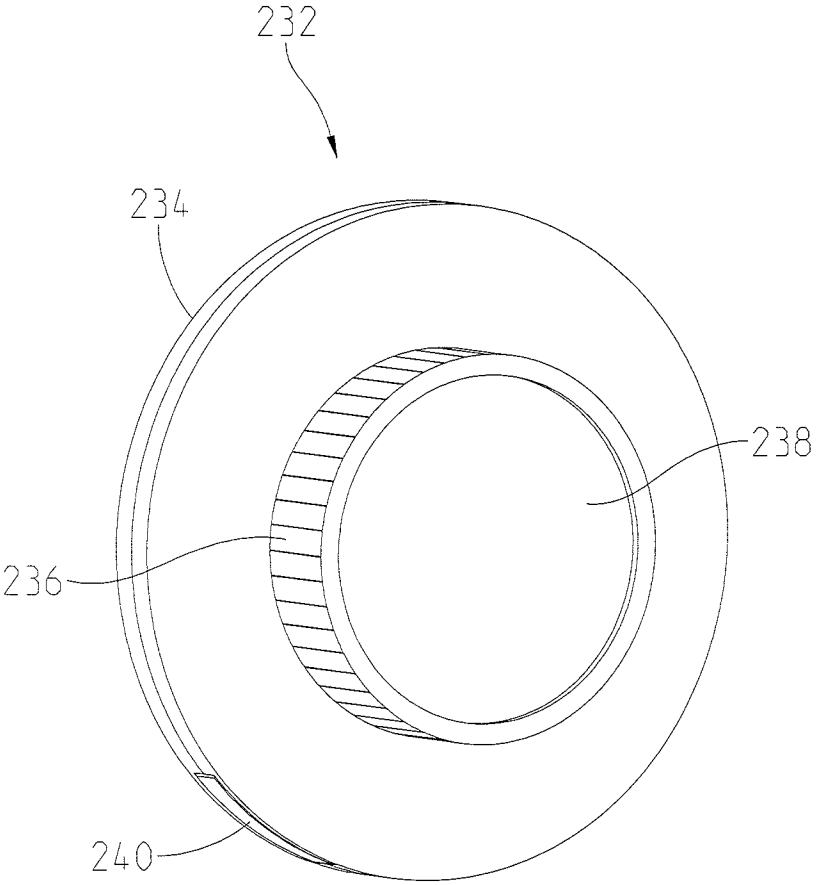
FIG. 22 is a perspective view of an illustrative escutcheon assembly for a shower system according to the present disclosure.
Figure 25:
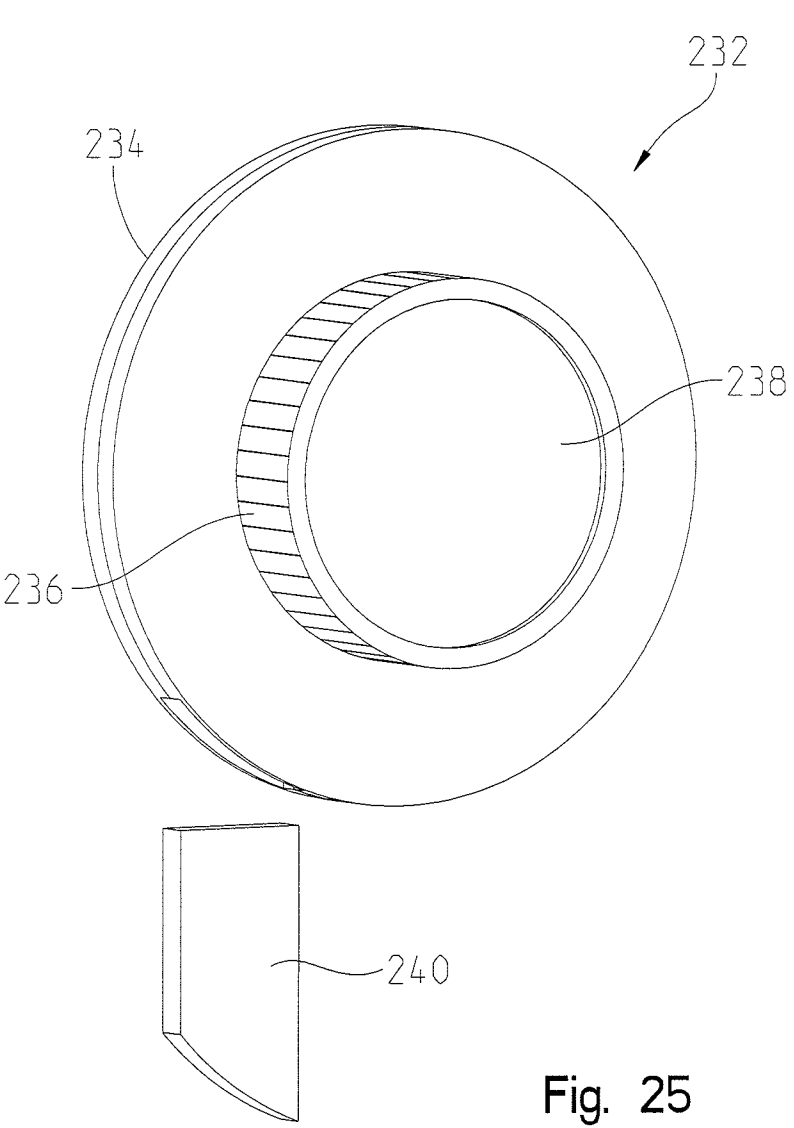
FIG. 25 is another perspective view of the escutcheon assembly of FIG. 22 with the power supply detached therefrom.
Figure 24:
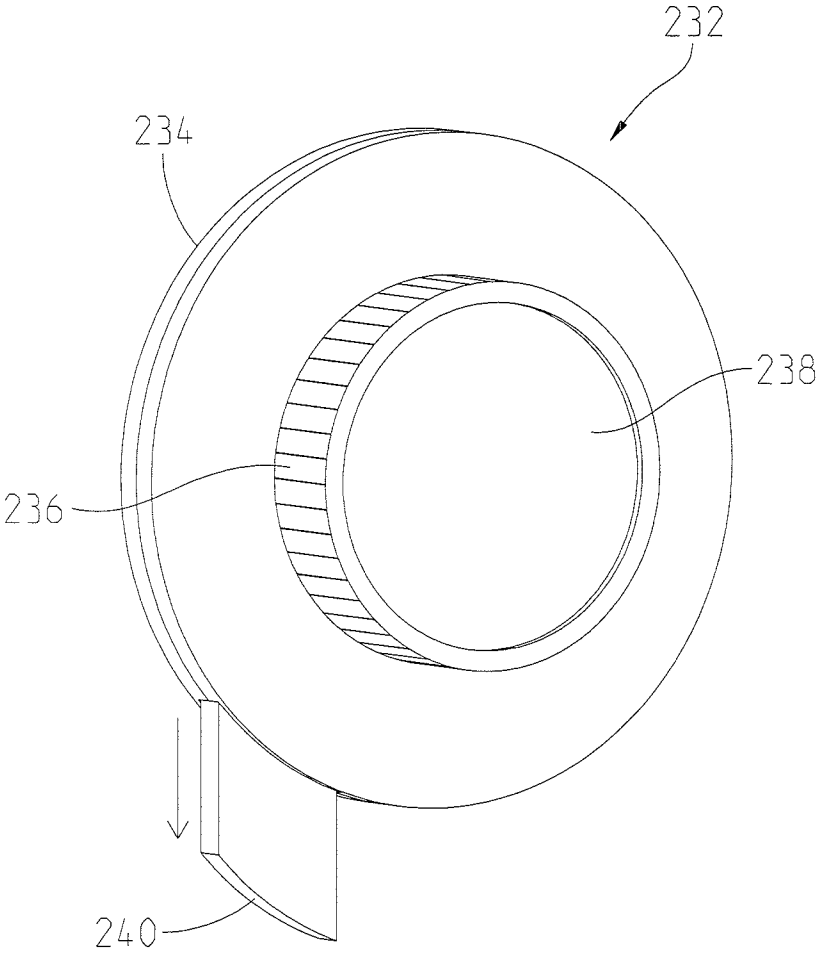
FIG. 24 is another perspective view of the escutcheon assembly of FIG. 22 with a power supply being detached therefrom.

With reference to FIG. 18, the first user interface device 208 is illustrated being coupled to a charging dock 220 to facilitate recharging the first user interface device 208. The charging dock 220 may be coupled to a power source (not shown—for example, an AC outlet). With reference to FIG. 19, the first user interface device 208 is illustrated coupled to the charging dock 220 and fully charged. The charging dock 220 may include an indicator 221 (illustratively, a light) that indicates when a coupled user interface device is fully charged.

User interfaces provided by any of the displays described herein, including the display of a smart device (phone, tablet, etc.) via a smart device app, may take various forms. For example, a user interface of a display according to an exemplary embodiment of the present disclosure may present the following system information and include the following user inputs: a water temperature indicator; a low battery indicator; a preset mode readout (a preset mode including, for example, combinations of water temperature settings, on/off times, etc.); a Wi-Fi status indicator; and an error indicator (indicating, for example, a temperature sensing error). A device including a display that provides such a user interface (for example, the user interface device 208) may further include a first separate user input that acts as an on/off button, a second separate user input that acts a first preset mode selection button, and a third separate user input that acts a second preset mode selection button.

As another example, a user interface of a display according to another exemplary embodiment of the present disclosure may present the following system information and include the following user inputs: a water temperature indicator; a power status indicator, a low battery indicator; a preset mode readout (a preset mode including, for example, combinations of water temperature settings, on/off times, etc.); one or more present mode selection inputs; a Wi-Fi status indicator; an error indicator (indicating, for example, a temperature sensing error); a music indictor and a music selection input; and water monitoring indicators (for example, a shower length indicator, a water usage indicator, etc.).

FIGS. 20A-20D illustrate exemplary screens 222*a*-222*d* of a user interface of a display according to another exemplary embodiment of the present disclosure. The user interface generally includes a time indictor, a spout indicators and selection inputs (illustratively, a bathtub and a showerhead), a user selection input, a temperature indicator and selection input, and a preset mode indicators and selection inputs.

FIGS. 21A-21E illustrate exemplary screens 224*a*-224*e* of a user interface of a display according to yet another exemplary embodiment of the present disclosure. The user interface generally includes spout indicators and selection inputs (illustratively, a showerhead, a handheld, and an overhead, etc.), auxiliary device indictors and selection inputs (illustratively, dry, steam, and clean devices), and preset mode modification inputs.

With brief reference again to FIG. 17, the power supply 112 may detachably couple to other components, such as the valve body 12. Examples of such power supplies are described in further detail below.

With reference to FIGS. 22-25, an illustrative escutcheon assembly 232 is illustrated. The escutcheon assembly 232 may form a part of the shower system 200 in lieu of the escutcheon 206 and the user interface devices 208, 212. The escutcheon assembly 232 obscures an electronic valve assembly (not shown), such as the electronic valve cartridge 14 (shown elsewhere). The escutcheon assembly 232 includes an escutcheon 234 that carries one or more displays and/or one or more user inputs. The displays and the user inputs that may be manipulated to control water flow, temperature, and other system features. Illustratively, the escutcheon assembly 232 includes a user input 236 (such as a rotatable knob or dial) that may be manipulated to control system features. Illustratively, the escutcheon assembly 232 includes a single electronic display 238 to present system information and act as an additional user input. The escutcheon assembly 232 further includes one or more detachable power supplies (for example, rechargeable batteries) for powering the electronic valve assembly. Illustratively, the escutcheon assembly 232 includes a single power supply 240 that is detachably carried by the escutcheon 234. The power supply 240 may be interchangeable with other power supplies of the same or similar type.

Figure 26:
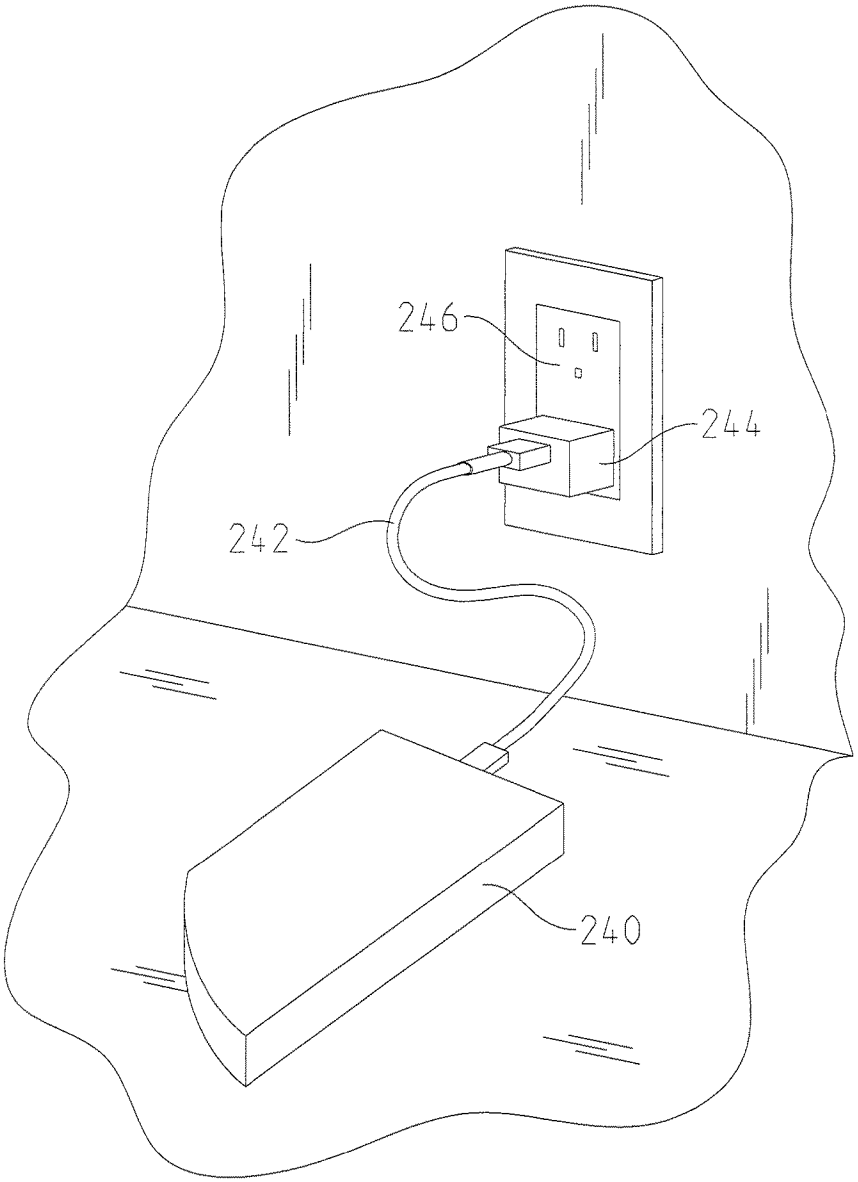
FIG. 26 is a perspective view of the power supply of FIGS. 24 and 25 coupled to and being recharged by a power source.

With reference to FIG. 26, the power supply 240 is illustrated coupled to, via a cable 242 and an adapter 244, and being recharged by a power source 246 (illustratively, an AC outlet).

Figure 28:
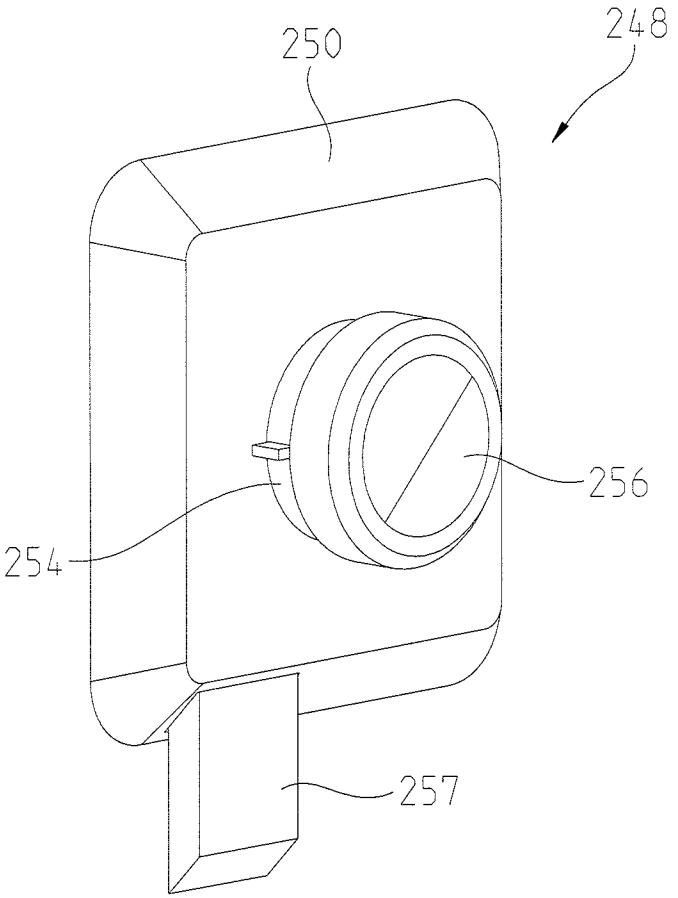
FIG. 28 is another perspective view of the escutcheon assembly of FIG. 25 with a power supply being detached therefrom.
Figure 27:
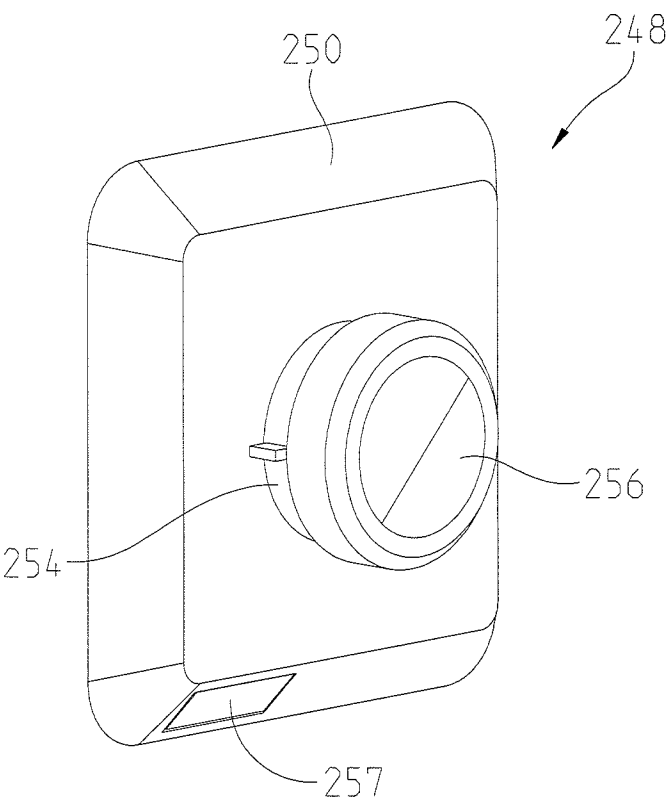
FIG. 27 is a perspective view of another illustrative escutcheon assembly for a shower system according to the present disclosure.

With reference to FIGS. 27 and 28, another illustrative escutcheon assembly 248 is shown. The escutcheon assembly 248 may form a part of the shower system 200 in lieu of the escutcheon 206 and the user interface devices 208, 212. The escutcheon assembly 248 obscures an electronic valve assembly (not shown), such as the electronic valve cartridge 14 (shown elsewhere). The escutcheon assembly 248 includes an escutcheon 250 that carries one or more displays and/or one or more user inputs. The user inputs that may be manipulated to control water flow and/or temperature. Illustratively, the escutcheon assembly 248 includes a single user input 254 and a single electronic display 256. The escutcheon assembly 248 further includes one or more detachable power supplies (for example, rechargeable batteries) for powering the electronic valve assembly. Illustratively, the escutcheon assembly 248 includes a single power supply 257 that is detachably carried by the escutcheon 250. The power supply 257 may be interchangeable with other power supplies of the same or similar type.

Figure 30:
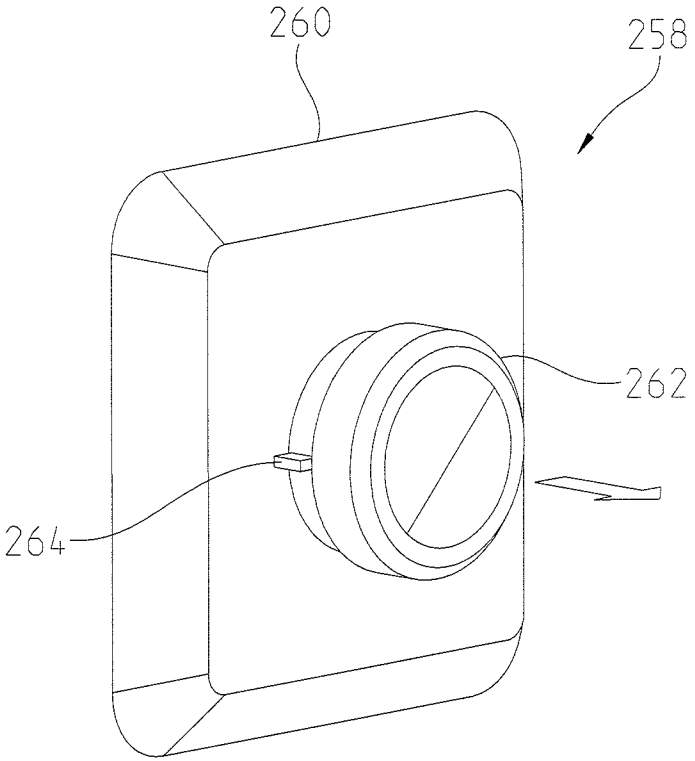
FIG. 30 is another perspective view of the escutcheon assembly of FIG. 28 with the user interface device being detached from the assembly.
Figure 29:
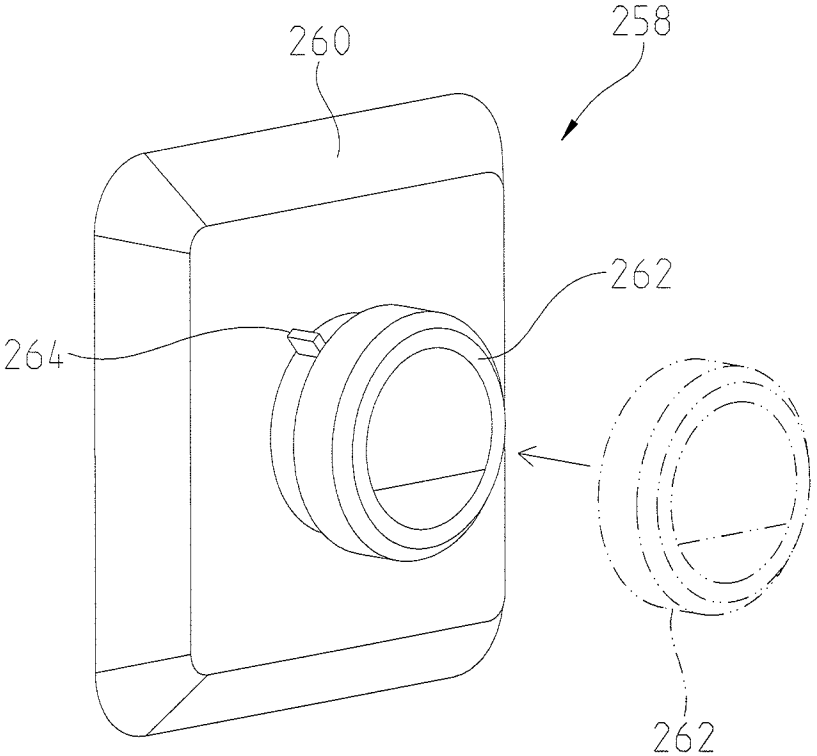
FIG. 29 is a perspective view of another illustrative escutcheon assembly for a shower system according to the present disclosure with a user interface device being attached to the assembly.

With reference to FIGS. 29 and 30, another illustrative escutcheon assembly 258 is illustrated. The escutcheon assembly 258 may form a part of the shower system 200 in lieu of the escutcheon 206 and the user interface devices 208, 212. The escutcheon assembly 258 obscures an electronic valve assembly (not shown), such as the electronic valve cartridge 14 (shown elsewhere). The escutcheon assembly 258 includes an escutcheon 260 that detachably carries a user interface device 262, which may be the same or similar to the user interface device 208. The escutcheon 260 also carries a manual user input 264 (that is, a non-electronic input—illustratively, a rotatable lever) that may override the user interface device 262 and may be manipulated to control water flow and/or temperature. This may be advantageous, for example, during power loss situations or if the power supply (not shown) of the user interface device 262 is depleted.

Figure 32:
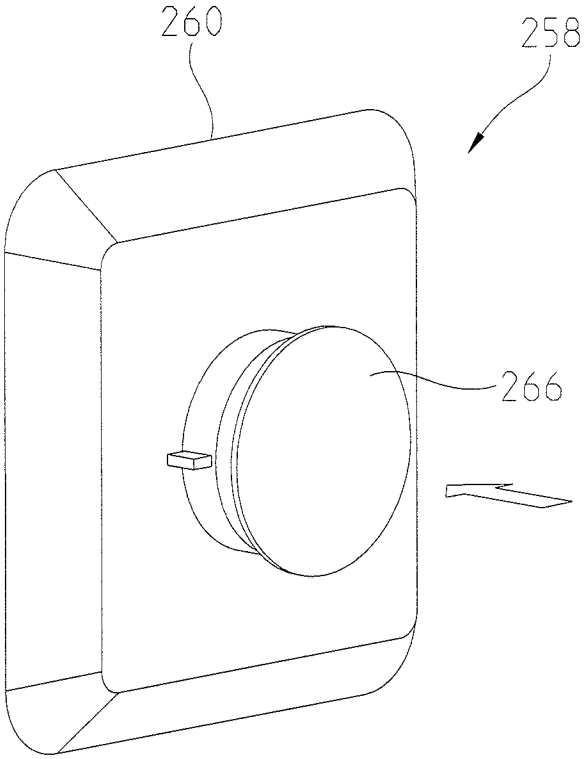
FIG. 32 is another perspective view of the escutcheon assembly of FIG. 29 with the manual actuation component being attached to the assembly.
Figure 31:
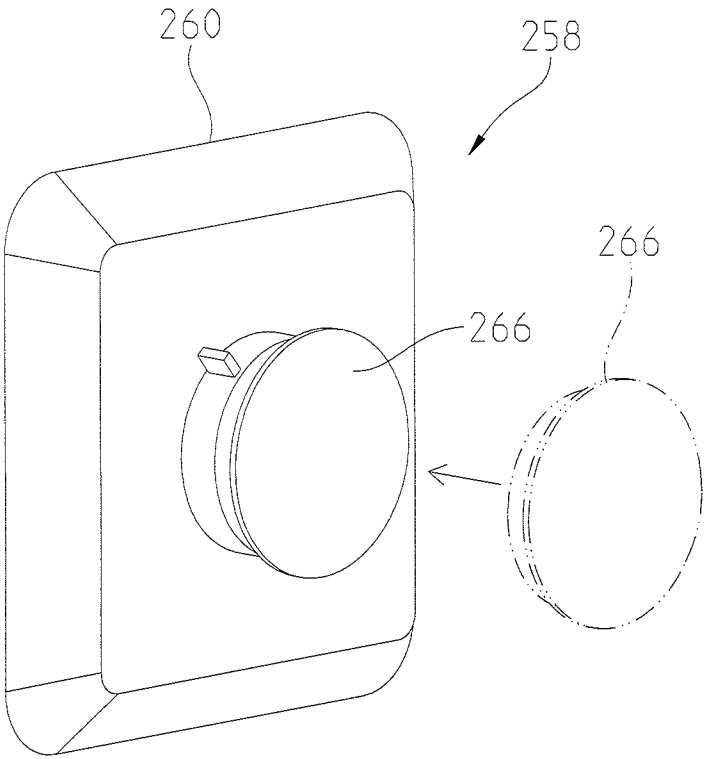
FIG. 31 is another perspective view of the escutcheon assembly of FIG. 29 with a manual actuation component being attached to the assembly.

With reference to FIGS. 31 and 32, the escutcheon assembly 258 is further illustrated. As illustrated, upon detachment of the user interface device 262 (shown elsewhere), the escutcheon 260 may receive a manual actuation component 266 that may be manipulated (more specifically, rotated relative to the escutcheon 260) to control water flow and/or temperature. More specifically, the manual actuation component 266 may include a keyed feature (not shown—a square shaft, a hexagonal shaft) that is received by the valve assembly (more specifically, the shaft 24—shown elsewhere) to facilitate manually controlling water flow and/or temperature. Alternatively, the user interface device 262 or a portion of the user interface device 262 may act as a manual actuation component. More specifically, the user interface device 262 or a portion of the user interface device 262 could be rotated relative to the escutcheon 250 to manually actuate the valve assembly (more specifically, the shaft 24—shown elsewhere) and thereby manually control water flow and/or temperature.

The illustrative valve assembly provides a compact electronic shower cartridge. Instead of a large bank of electronic valves or solenoids that require special installation, the present invention provides a retrofittable solution.

Although the invention has been described in detail with reference to certain preferred embodiments, variations and modifications exist within the spirit and scope of the invention as described and defined in the following claims.

The invention claimed is:

1. An electronic shower valve comprising:

a valve body; and a valve cartridge received within the valve body, the valve cartridge including:

an outer housing including a cylindrical sidewall defining a single internal chamber extending along a longitudinal axis, a hot water inlet in fluid communication with the internal chamber, a cold water inlet in fluid communication with the internal chamber, a flow control element supported within the internal chamber of the outer housing for rotation about the longitudinal axis to control water flow through the hot water inlet and the cold water inlet;

a valve shaft operably coupled to the flow control element and coaxially aligned with the longitudinal axis;

a motor assembly positioned radially within the cylindrical sidewall of the outer housing and received within the internal chamber of the outer housing and coaxially aligned with the longitudinal axis; and a gear assembly operably coupling the motor assembly and the flow control element, the gear assembly configured to rotate the flow control element, positioned radially within the cylindrical sidewall of the outer housing and received within the internal chamber of the outer housing, such that the gear assembly operably couples with the valve shaft within the internal chamber of the outer housing.

2. The electronic shower valve of claim 1, wherein the gear assembly is at least partially supported within the outer housing and is coaxially aligned with the longitudinal axis.

3. The electronic shower valve of claim 2, wherein the gear assembly comprises a strain wave gearing assembly.

4. The electronic shower valve of claim 3, wherein the strain wave gearing assembly includes an outer circular spline supported by the outer housing, a flex spline cooperating with the outer circular spline, and a wave generator supported for rotation about the longitudinal axis, wherein the flex spline is positioned intermediate the wave generator and the outer circular spline.

5. The electronic shower valve of claim 1, wherein the motor assembly includes a fixed stator coaxially aligned with the longitudinal axis, and a rotor configured for rotation relative to the stator.

6. The electronic shower valve of claim 5, wherein the rotor includes a body, circumferentially spaced magnets supported by the body, a bearing intermediate the body and the gear assembly, and an elliptical cam supported by the body and cooperating with the gear assembly.

7. The electronic shower valve of claim 6, wherein the stator includes a center hub and electrical windings supported by the center hub.

8. The electronic shower valve of claim 7, wherein the hub is formed of a polymer overmolded around the electrical windings.

9. The electronic shower valve of claim 1, further comprising a controller, and an angular sensor configured to detect an angular position of the flow control element and provide a signal indicative thereof to the controller.

10. The electronic shower valve of claim 1, further comprising a controller, and a temperature sensor configured to detect a temperature of water provided to an outlet and provide a signal indicative thereof to the controller.

11. The electronic shower valve of claim 10, wherein the temperature sensor comprises a thermistor, the flow control element includes a center opening, and the thermistor extends through the center opening.

12. The electronic shower valve of claim 1, further comprising a rechargeable power supply detachably coupled to the valve body and configured to power the motor assembly.

13. The electronic shower valve of claim 1, further comprising a valve shaft including a longitudinal passageway, and a cable electrically coupled to the motor assembly and extending through the longitudinal passageway.

14. A shower valve cartridge comprising:

an outer housing including an internal chamber defining a longitudinal axis;

a hot water inlet in fluid communication with the internal chamber;

a cold water inlet in fluid communication with the internal chamber;

a flow control element supported for rotation about the longitudinal axis to control water flow through the hot water inlet and the cold water inlet;

a motor assembly received within the internal chamber of the outer housing and coaxially aligned with the longitudinal axis;

a strain wave gearing assembly operably coupling the motor assembly and the flow control element, the strain wave gearing assembly received within the internal chamber of the outer housing and configured to rotate the flow control element; and wherein the strain wave gearing assembly includes an outer circular spline supported by the outer housing, a flex spline concentrically received within and cooperating with the outer circular spline, and a wave generator including a rotor having an elliptical cam supported for rotation about the longitudinal axis, wherein the flex spline is positioned intermediate the elliptical cam of the wave generator and the outer circular spline, the flex spline configured to be moved relative to the outer circular spline by rotation of the elliptical cam of the wave generator for rotating the flow control element about the longitudinal axis.

15. The shower valve cartridge of claim 14, wherein the motor assembly includes:

a fixed stator coaxially aligned with the longitudinal axis and including electrical windings; and the rotor is configured for rotation relative to the stator, wherein the rotor includes a body, circumferentially spaced magnets supported by the body, a bearing intermediate the body and the gear assembly, and the elliptical cam supported by the body and cooperating with the gear assembly.

16. The shower valve cartridge of claim 15, wherein the stator includes a center hub supporting the electrical windings, the center hub formed of a polymer overmolded around the electrical windings.

17. The shower valve cartridge of claim 14, further comprising a controller, and an angular sensor configured to detect an angular position of the flow control element and provide a signal indicative thereof to the controller.

18. The shower valve cartridge of claim 14, further comprising a controller, and a temperature sensor configured to detect a temperature of water provided to an outlet and provide a signal indicative thereof to the controller.

19. The shower valve cartridge of claim 18, wherein the temperature sensor comprises a thermistor, the flow control element includes a center opening, and the thermistor extends through the center opening.

20. The shower valve cartridge of claim 14, wherein the outer housing is received within a valve body.

21. The shower valve cartridge of claim 20, further comprising a rechargeable power supply detachably coupled to the valve body and configured to power the motor assembly.

22. The shower valve cartridge of claim 14, further comprising a valve shaft including a longitudinal passageway, and a cable electrically coupled to the motor assembly and extending through the longitudinal passageway.

23. An electronic shower valve comprising:

a valve body; and a valve cartridge received within the valve body, the valve cartridge including:

an outer housing including a cylindrical sidewall defining a single internal chamber extending along a longitudinal axis, a hot water inlet in fluid communication with the internal chamber, a cold water inlet in fluid communication with the internal chamber, a flow control element supported within the internal chamber of the outer housing for rotation about the longitudinal axis to control water flow through the hot water inlet and the cold water inlet, a valve shaft operably coupled to the flow control element and coaxially aligned with the longitudinal axis, a motor assembly positioned radially within the cylindrical sidewall of the outer housing and received within the internal chamber of the outer housing and coaxially aligned with the longitudinal axis, wherein the motor assembly includes a fixed stator coaxially aligned with the longitudinal axis, and a rotor configured for rotation relative to the stator, a gear assembly operably coupling the motor assembly and the flow control element, the gear assembly configured to rotate the flow control element, positioned radially within the cylindrical sidewall of the outer housing and received within the internal chamber of the outer housing, such that the gear assembly operably couples with the valve shaft within the internal chamber of the outer housing, and wherein the gear assembly is at least partially supported within the outer housing and is coaxially aligned with the longitudinal axis;

a controller;

an angular sensor configured to detect an angular position of the flow control element and provide a signal indicative thereof to the controller; and a temperature sensor configured to detect a temperature of water provided to an outlet and provide a signal indicative thereof to the controller.

24. The electronic shower valve of claim 23, wherein the gear assembly comprises a strain wave gearing assembly.

25. The electronic shower valve of claim 24, wherein the strain wave gearing assembly includes an outer circular spline supported by the outer housing, a flex spline cooperating with the outer circular spline, and a wave generator supported for rotation about the longitudinal axis, wherein the flex spline is positioned intermediate the wave generator and the outer circular spline.

26. The electronic shower valve of claim 23, wherein the stator includes a center hub and electrical windings supported by the center hub.

27. The electronic shower valve of claim 26, wherein the hub is formed of a polymer overmolded around the electrical windings.

28. The electronic shower valve of claim 23, wherein the temperature sensor comprises a thermistor, the flow control element includes a center opening, and the thermistor extends through the center opening.

29. The electronic shower valve of claim 23, further comprising a rechargeable power supply detachably coupled to the valve body and configured to power the motor assembly.

30. The electronic shower valve of claim 23, further comprising a valve shaft including a longitudinal passageway, and a cable electrically coupled to the motor assembly and extending through the longitudinal passageway.

31. The electronic shower valve of claim 1, wherein:

the cylindrical sidewall of the outer housing extends between opposing ends; and the motor assembly and the gear assembly are longitudinally positioned between the opposing ends of the cylindrical sidewall.

32. The shower valve cartridge of claim 14, wherein:

the outer housing includes a sidewall extending between opposing ends and defining the internal chamber; and the motor assembly and the strain wave gearing assembly are longitudinally positioned between the opposing ends of the sidewall.

33. The electronic shower valve of claim 23, wherein:

the cylindrical sidewall of the outer housing extends between opposing ends; and the motor assembly and the gear assembly are longitudinally positioned between the opposing ends of the cylindrical sidewall.

* * * * *